US008359983B2

(12) United States Patent
Williamson et al.

(10) Patent No.: US 8,359,983 B2
(45) Date of Patent: Jan. 29, 2013

(54) ADJUSTABLE TABLE APPARATUS AND METHOD

(75) Inventors: Scott Gerald Williamson, Rochester, MN (US); Benjamin St. Mane Conway, Chatfield, MN (US); Mark Von Der Heide, London (GB); Jorge Enrique Ramos Herrera, London (GB); James Lawrence, London (GB)

(73) Assignee: Halcon Inc., Stewartville, MN (US)

( * ) Notice: Subject to any disclaimer, the term of this patent is extended or adjusted under 35 U.S.C. 154(b) by 55 days.

(21) Appl. No.: 13/151,851

(22) Filed: Jun. 2, 2011

(65) Prior Publication Data

US 2012/0304897 A1 Dec. 6, 2012

(51) Int. Cl.
*A47B 3/00* (2006.01)

(52) U.S. Cl. ..... 108/115; 108/132

(58) Field of Classification Search ..... 108/115, 108/64, 123, 124, 128, 131, 132, 133, 134, 108/160, 50.01, 50, 118; 248/188.8, 188.6, 248/188.1, 188, 166, 434, 439, 440
See application file for complete search history.

(56) References Cited

U.S. PATENT DOCUMENTS

| | | | | | |
|---|---|---|---|---|---|
| 2,596,663 | A | * | 5/1952 | Duffy | 108/69 |
| 2,836,475 | A | * | 5/1958 | Sapp | 108/64 |
| 3,342,147 | A | * | 9/1967 | Shettles | 108/64 |
| 3,558,152 | A | * | 1/1971 | Miles et al. | 280/47.16 |
| 4,150,630 | A | * | 4/1979 | Pokorny et al. | 108/64 |
| 4,502,393 | A | * | 3/1985 | Kaiser | 108/1 |
| 4,915,034 | A | * | 4/1990 | Grabe et al. | 108/65 |
| 5,005,848 | A | * | 4/1991 | Cornell | 280/79.11 |
| 5,109,778 | A | | 5/1992 | Berkowitz et al. | |
| 5,121,697 | A | | 6/1992 | Baum et al. | |
| 5,182,996 | A | | 2/1993 | Gutgsell | |
| 5,205,223 | A | * | 4/1993 | Ball et al. | 108/124 |
| 5,337,657 | A | * | 8/1994 | Diffrient | 108/115 |
| 5,398,620 | A | * | 3/1995 | Rouch | 108/1 |
| 5,562,052 | A | * | 10/1996 | Glashouwer et al. | 108/147.21 |
| 5,638,761 | A | | 6/1997 | Berkowitz et al. | |
| 5,927,214 | A | * | 7/1999 | Schwartz et al. | 108/128 |
| 6,041,721 | A | * | 3/2000 | Weston | 108/65 |
| 6,082,838 | A | * | 7/2000 | Bissu-Palombo | 312/195 |
| 6,170,407 | B1 | * | 1/2001 | Hayward | 108/50.02 |
| 6,314,892 | B1 | * | 11/2001 | Favini | 108/115 |
| 6,336,414 | B1 | * | 1/2002 | Stewart et al. | 108/50.02 |
| 6,637,352 | B1 | * | 10/2003 | Thode et al. | 108/132 |
| 6,647,900 | B1 | * | 11/2003 | Kopish | 108/50.02 |
| 6,845,723 | B2 | | 1/2005 | Kottman et al. | |
| 6,997,115 | B2 | * | 2/2006 | Lockwood et al. | 108/115 |
| 7,066,098 | B2 | | 6/2006 | Blasen et al. | |
| 7,634,968 | B2 | * | 12/2009 | Cornelius | 108/115 |
| 7,765,938 | B2 | * | 8/2010 | Piretti | 108/115 |
| 7,878,128 | B2 | * | 2/2011 | Watson et al. | 108/132 |
| 8,069,795 | B1 | * | 12/2011 | Williams et al. | 108/115 |
| 2007/0137534 | A1 | | 6/2007 | Dhanoa et al. | |
| 2009/0114130 | A1 | | 5/2009 | Chirea et al. | |

* cited by examiner

OTHER PUBLICATIONS

Clarin, Fast Brake Nesting Table, 2011 [retrieved on Jun. 7, 2011]. Retrieved from the internet: <URL: http://www.clarinseating.com/literature/Fast%20Brake%20small.pdf>.

*Primary Examiner* — Jose V Chen
(74) *Attorney, Agent, or Firm* — Fish & Richardson P.C.

(57) ABSTRACT

Some embodiments of a table system can include a table that is readily adjustable between a deployed position and a storage position. In particular embodiments, when the table is in the unlocked condition, the tabletop surface can be readily pivoted from a generally horizontal position to a generally vertical position, for example, for purposes of storing or transporting the table.

50 Claims, 10 Drawing Sheets

ADJUSTABLE TABLE APPARATUS AND METHOD

TECHNICAL FIELD

This document relates to an adjustable table apparatus and related systems and methods.

BACKGROUND

Tables and other furniture items are often used in flexible spaces, such as in commercial and institutional settings, in which the furniture items can be moved from a deployed positioned to a storage position. For example, in some large rooms, the space may be used for a number of different purposes, which can create a need to promptly move, deploy, or store the furniture items therein. Some prior art table systems employ a collapsible table in which the legs of the table can be adjusted from an upright orientation (e.g., for use when the table is deployed) to collapsed position in which the table legs are folded toward a lower surface of the table. In such circumstances, each collapsible table can be adjusted to the collapsed position and manually carried away for storage. Other prior art table systems employ a flip top table in which the table top surface can be adjusted from a generally horizontal orientation (e.g., for use when the table is deployed) to a generally vertical position (e.g., for use when the table is being stored). In many flip top table systems, the table legs are a construction of metal tubes having caster wheels mounted thereto for rolling the table along a floor surface.

SUMMARY

Some embodiments of a table system can include a table that is readily and safely adjustable between a deployed position and a storage position. Moreover, the table system may provide an aesthetic and sleek appearance that, when in the deployed position, conceals a number of movable mechanical components employed in the process of adjusting the table system between the deployed position and the storage position. In particular embodiments, the table system can include at least two leg panels that are pivotable about respective generally vertical axes so as to adjust the tabletop from a locked condition to an unlocked condition. When the tabletop is in the unlocked condition, the tabletop surface can be readily pivoted from a generally horizontal position to a generally vertical position, for example, for purposes of storing or transporting the table system to another location. Furthermore, in some embodiments, the table system can include a plurality of tables that are each equipped with gang mechanisms to couple the tables in various side-by-side configurations. In such embodiments, when the plurality of tables are adjusted to the storage position (e.g., in which the table top surfaces are positioned generally vertical), the tables can be arranged in a nested configuration to conserve additional space during storage.

In some embodiments, a table apparatus may include a tabletop including an upper surface and a lower surface. The upper surface of the tabletop may extend in a generally horizontal orientation when the table apparatus is in a deployed position. The apparatus may also include first and second pivotable leg panels extending generally vertically downward away from the lower surface of tabletop when the upper surface of the tabletop is in the generally horizontal orientation. The first pivotable leg panel may be pivotable about a first generally vertical axis while the upper surface of the table top is in the generally horizontal orientation, and the second pivotable leg panel may be pivotable about a second generally vertical axis while the upper surface of the table top is in the generally horizontal orientation. The first and second pivotable leg panels may be pivoted about the first and second generally vertical axes to adjust the tabletop from a locked condition to an unlocked condition. When the tabletop is in the unlocked condition, the tabletop may be pivotable about a generally horizontal axis to adjust the upper surface of the tabletop from the generally horizontal orientation to a generally vertical orientation.

In particular embodiments, a table apparatus may include a tabletop including an upper surface and a lower surface. The upper surface of the tabletop may extend in a generally horizontal orientation when the table apparatus is in a deployed position, and the tabletop may be adjustable about a generally horizontal axis to adjust the upper surface of the tabletop from the generally horizontal orientation to a generally vertical orientation. The apparatus may also include first and second pivotable leg panels extending generally vertically downward away from the lower surface of tabletop when the upper surface of the table top is in the generally horizontal orientation. The first and second pivotable leg panels each may have a major surface extending generally vertically and may be defined by a panel width and a panel height. The panel width and the panel height may be substantially greater than a panel thickness. The first pivotable leg panel may be pivotable relative to the tabletop about a first generally vertical axis while the upper surface of the table top is in the generally horizontal orientation. The second pivotable leg panel may be pivotable relative to the table top about a second generally vertical axis while the upper surface of the table top is in the generally horizontal orientation.

Some embodiments include a method of adjusting a table apparatus. The method may include rotating a first leg panel relative to a tabletop about a first generally vertical axis while the tabletop extends in a generally horizontal orientation. The first leg panel may have a first major surface extending generally vertically and being defined by a first panel width and a first panel height. The first panel width and the first panel height may be substantially greater than a first panel thickness. The method may also include rotating a second leg panel relative to the tabletop about a second generally vertical axis while the tabletop is in a generally horizontal orientation. The second leg panel may have a second major surface extending generally vertically and being defined by a second panel width and a second panel height. The second panel width and the second panel height may be substantially greater than a second panel thickness. The method may further include, after rotating the first and second leg panels about the first and second generally vertical axes, rotating the tabletop about a generally horizontal axis from the generally horizontal orientation to a generally vertical orientation.

In particular embodiments, a table apparatus may include a tabletop including an upper surface and a lower surface. The tabletop may extend in a generally horizontal orientation when the table apparatus is in a deployed position. The tabletop may be pivotable about a generally horizontal axis to adjust the tabletop from the generally horizontal orientation to a generally vertical orientation. The apparatus may also include a first lock mechanism to retain the tabletop in the generally horizontal orientation. The first lock mechanism may be actuated to unlock the tabletop in response to a pivoting motion of a first leg member. The apparatus may further include a second lock mechanism to retain the tabletop in the generally horizontal orientation. The second lock mechanism may be spaced apart from the first lock mechanism, and the second lock mechanism may be actuated to unlock the tabletop in response to a pivoting motion of a second leg member.

In some embodiments, a table apparatus may include a tabletop including an upper surface and a lower surface. The tabletop may extend in a generally horizontal orientation when the table apparatus is in a deployed position. The tabletop may be pivotable about a generally horizontal axis to adjust the tabletop from the generally horizontal orientation to a generally vertical orientation. The apparatus may also include first and second base assemblies extending between a floor surface and the tabletop. Each of the first and second base assemblies may include wheels to engage the floor surface. The apparatus may further include a first floor brake mechanism to secure the first base assembly in a generally stationary position relative to the floor surface when the tabletop is in the generally horizontal orientation. The first floor brake mechanism may extend at least partially through the first base assembly and may be spring biased away from the floor surface such that the first floor brake mechanism is configured to rise away from the floor surface in response to adjustment of the tabletop from the generally horizontal orientation to a generally vertical orientation. Optionally, the apparatus may also include a second floor brake mechanism to secure the second base assembly in a generally stationary position relative to the floor surface when the tabletop is in the generally horizontal orientation. The second floor brake mechanism may be spaced apart from the first floor brake mechanism, and the second floor brake mechanism may extend at least partially through the second base assembly. The second floor brake mechanism may be spring biased away from the floor surface such that the second floor brake mechanism is configured to rise away from the floor surface in response to adjustment of the tabletop from the generally horizontal orientation to a generally vertical orientation.

Particular embodiments of a table apparatus may include at least one base extending generally vertically from a floor surface. Also, the table apparatus may include a tabletop positioned over the at least one base and including an upper surface and a lower surface that extend toward four corners of the tabletop. The upper surface of the tabletop may configured to extend in a generally horizontal orientation. Optionally, the table apparatus may also include four tabletop leveling mechanisms. The four tabletop leveling mechanisms may be mounted proximate to the lower surface of the tabletop such that each of the four tabletop leveling mechanisms is mounted in a position vertically closer to the lower surface of tabletop than to the at least one base. Each of the four tabletop leveling mechanisms may be configured to at least partially control a height adjustment of a respective corner of the four corners of the tabletop.

Some embodiments of a table apparatus may include a tabletop positioned over the at least one base and including an upper surface and a lower surface that extend toward four corners of the tabletop. The upper surface of the tabletop may be configured to extend in a generally horizontal orientation. Optionally, the table apparatus may also include four gang mechanisms. The four gang mechanisms may be mounted proximate to the lower surface of the tabletop such that each of the four gang mechanisms resides in a respective cavity in the lower surface of the tabletop. Each gang mechanism may be adjustable between a non-deployed position in which the entire gang mechanism is retained at or above of the lower surface of the tabletop when the upper surface of the tabletop is in the generally horizontal orientation and a deployed orientation in which at least a portion of the gang mechanism is configured to couple with another tabletop.

In particular embodiments, a table apparatus may include a tabletop positioned over the at least one base and including an upper surface and a lower surface that extend toward four corners of the tabletop. The upper surface of the tabletop may be configured to extend in a generally horizontal orientation. Optionally, the table apparatus may also include four gang mechanisms. The four gang mechanisms may be mounted proximate to the lower surface of the tabletop such that each of the four gang mechanisms is mounted proximate to a respective one of the four corners of the table top and is configured to couple with another tabletop. Each gang mechanism may extend for a longitudinal length that is a maximum dimension for the gang mechanism. The longitudinal length of the gang mechanism located proximate to a first corner of the tabletop may extend generally perpendicularly to the longitudinal lengths of the two gang mechanisms located proximate to the two corners of the table top that are neighboring the first corner of the tabletop.

In some embodiments, a table apparatus may include a tabletop positioned over at least one base and including an upper surface, a lower surface, and at least one table edge. The upper surface of the tabletop may be configured to extend in a generally horizontal orientation. Optionally, the table apparatus may include a gang mechanism mounted proximate to the lower surface of the tabletop and proximate to the table edge. The gang mechanism may include a movable member having a single degree of freedom. The movable member of the gang mechanism may be adjustable between a non-deployed position and a deployed orientation in which the movable member of the gang mechanism is configured to couple with another tabletop.

Particular embodiments of a table apparatus may include a tabletop positioned over at least one base and including an upper surface, a lower surface, and at least one table edge. The upper surface of the tabletop may be configured to extend in a generally horizontal orientation. The table apparatus may also include a gang mechanism mounted proximate to the lower surface of the tabletop and proximate to the table edge. The gang mechanism may include a fixed member and a movable member that is movable between a non-deployed position and a deployed orientation in which the movable member of the gang mechanism is configured to couple with another tabletop. The movable member of the gang mechanism may be retained in the non-deployed position by a magnetic force between first magnetically attractive component of the movable member and a second magnetically attractive component of the fixed member.

Some embodiments of a table apparatus may include a tabletop including an upper surface and a lower surface. The upper surface of the tabletop may extend in a generally horizontal orientation when the table apparatus is in a deployed position. The tabletop may be adjustable about a generally horizontal axis to adjust the upper surface of the tabletop from the generally horizontal orientation to a generally vertical orientation. The table apparatus may also include first and second pivotable leg panels extending generally vertically downward away from the lower surface of tabletop when the upper surface of the table top is in the generally horizontal orientation. Optionally, each of the first and second pivotable leg panels may be biased to automatically adjust from a lower vertical height to a higher vertical height in response to the tabletop being pivoted about the generally horizontal axis to adjust the upper surface of the tabletop from the generally horizontal orientation to the generally vertical orientation.

In particular embodiments, a table apparatus may include at least a first base to extend generally vertically from a floor surface. The apparatus may also include a tabletop positioned above the first base and including an upper surface and a lower surface. The upper surface of the tabletop may extend in a generally horizontal orientation when the table apparatus is in a deployed position. Optionally, the table apparatus may also include a least a first pivotable leg panel extending generally vertically downward away from the lower surface of tabletop when the upper surface of the table top is in the generally horizontal orientation. The first pivotable leg panel may be pivotable relative to the first base and the tabletop about a first generally vertical axis while the upper surface of the table top is in the generally horizontal orientation. Optionally, the table apparatus may further include an adjustable catch mechanism to secure the first pivotable leg panel in a generally aligned orientation with the first base when the first pivotable leg panel is pivoted toward the first base. The adjustable catch mechanism may include a first catch component mounted to first base such that the first catch component is manually adjustable relative to the first base.

Some or all of the embodiments described herein may provide one or more of the following benefits. First, some embodiments of an adjustable table can be configured to readily shift between deployed and non-deployed positions for use, for example, in a flexible space. As such, the table may be conveniently deployed in the flexible space for use as a table, and then promptly adjusted to the non-deployed position when moving or storing the table.

Second, some embodiments of the table described herein may provide an aesthetic appearance that can be suitable, for example, as a formal conference table. In particular embodiments, most of the mechanical components and metal base components can be concealed from view by relatively large leg panels that may provide a finished and sleek appearance. Moreover, in certain implementations, the table may be equipped with caster wheels in which a majority of each caster wheel is substantially conceal from view (e.g., by the feet of the base) while the table is in the deployed position.

Third, particular embodiments of the table can provide a plurality of independent locks that retain the tabletop in the generally horizontal orientation. As such, the multiple independent locks can increase safety and reduce the likelihood of the tabletop inadvertently becoming unlocked and shifting to a generally vertical orientation.

Fourth, in some embodiments, the table can be equipped with one or more brake mechanisms that are configured to automatically anchor the table to the floor surface when the table is deployed. The automatic engagement of the one or more brake mechanisms can increase the safety of the table by reducing the likelihood that the table is inadvertently rolled along the floor when in the deployed position.

Fifth, the table may be equipped with a plurality of leveling mechanisms that are positioned near the underside of the table top (e.g., not near the floor or the caster wheels). The leveling mechanisms can be conveniently accessed by a user to independent adjust the height levels for respective corners of the tabletop, thereby enabling side-by-side table leveling when multiple tables are positioned adjacent to one another.

Sixth, some embodiments of the table may include a plurality of gang mechanisms that permit multiple tables to be coupled together in a variety of different arrangements. In particular embodiments, each gang mechanism is assembled into the underside of the tabletop in a manner that is positioned at or above the lower surface of the tabletop. Furthermore, each gang mechanism can be readily operated with a single degree of freedom for a simplified process to gang side-by-side tables.

Seventh, some embodiments of the table can be particular suited for nesting with other tables when in the non-deployed position. In particular, the leg panels of each table may be configured to provide sufficient clearance for the base structure of another neighboring table when the tables are nested together during storage.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
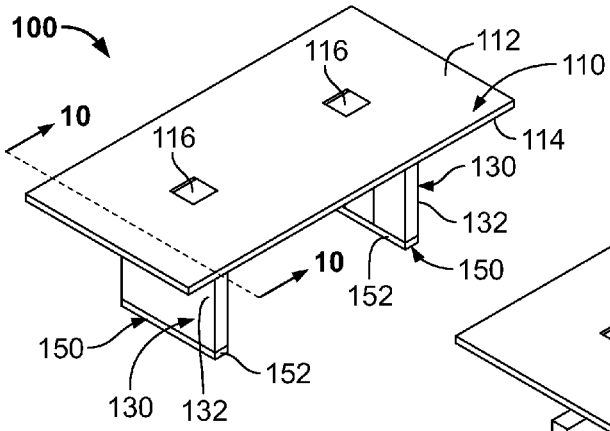
FIG. 1 is a perspective view of an adjustable table in a deployed position, in accordance with some embodiments.
Figure 2:
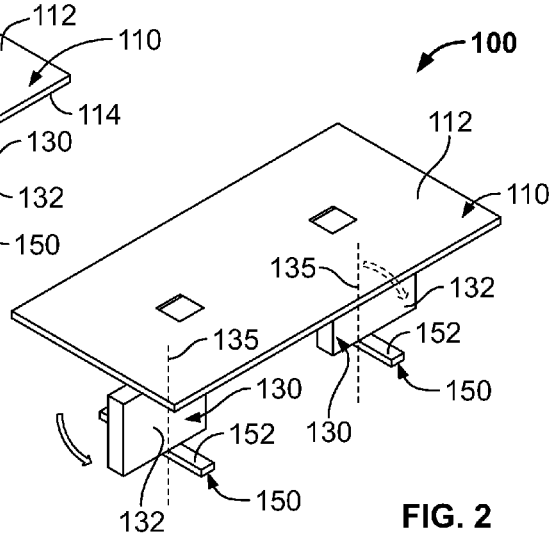
FIG. 2 is a perspective view of the adjustable table of FIG. 1 in an intermediate position.
Figure 3:
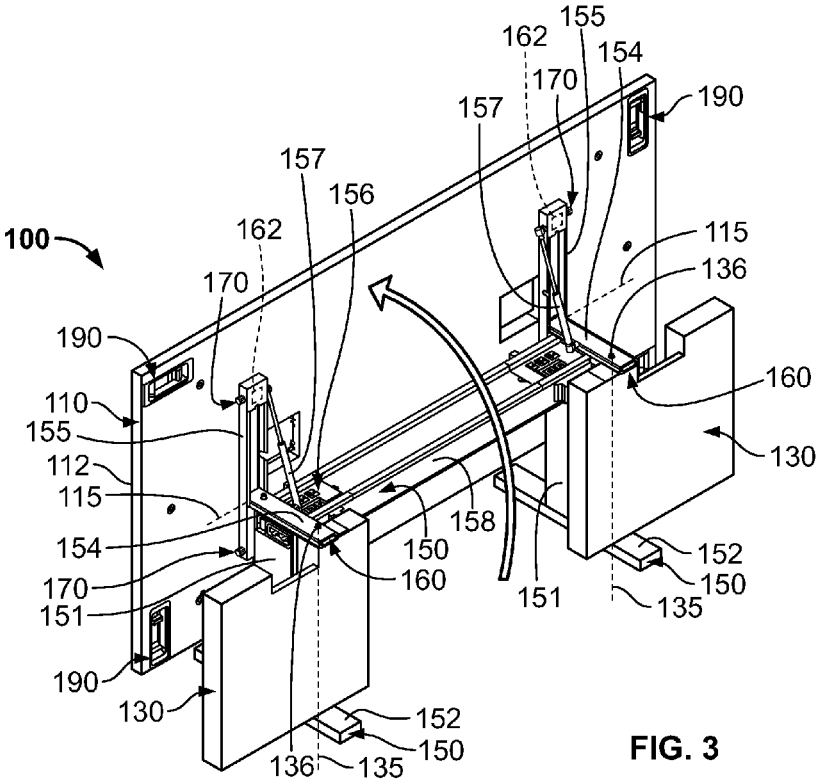
FIG. 3 is a perspective view of the adjustable table of FIG. 1 in a non-deployed position.

Referring to FIGS. 1-3, some embodiments of an adjustable table 100 can be readily adjustable between a deployed position (FIG. 1) and a non-deployed position (FIG. 3). In this embodiment, the table 100 includes a tabletop 110, at least two leg panels 130, and base structure 150. As described in more detail below, the leg panels 130 can be pivotable about respective generally vertical axes 135 so as to adjust the tabletop 110 from a locked condition to an unlocked condition. When the tabletop 110 is in the unlocked condition, an upper surface 112 of the tabletop 110 can be readily pivoted about a generally horizontal axis 115 from a generally horizontal position (FIG. 1) to a generally vertical position (FIG. 3), for example, for purposes of storing or transporting the table 100 to another location. In preferred embodiments, the tabletop 110 and the leg panels 130 comprise a wood material that provides an aesthetic and clean appearance for the table 100, and that serves to conceal substantial portions of the base 150 which may comprise a metal material. For example, in some embodiments, the table 100 may serve as a large formal conference table when in the deployed position (FIG. 1), and the table can be promptly adjusted to the non-deployed position (FIG. 3) for purposes of converting the flexible room space for a different use. It should be understood from the description herein, that the depicted embodiment and other embodiments of the table can be employed for uses other than a conference table and may have different outer appearances or materials.

As shown in FIG. 1, the table top 110 can have an upper surface 112 and a lower surface 114 that is generally opposite to the upper surface 112. The upper surface 112 can extend in a generally horizontal plane when the table 100 is in the deployed position. Each of the leg panels 130 can include a major surface 132 that extends in a generally vertical plane such that the major surfaces 132 of the leg panels 130 are oriented generally perpendicularly to the upper surface 112 of the table top 110 when the table 100 is in the deployed position. In some preferred embodiments, the leg panels 132 may have the appearance of relatively large slabs that are pivotable about the respective generally vertical axes 135 while the tabletop 110 is in the generally horizontal orientation. For example, the upper surface of the tabletop 100 may have a width of about 36 inches to about 60 inches (preferably about 48 inches in this embodiment) and a length of about 72 includes to about 120 includes (preferably about 96 inches in this embodiments), while the major surface 132 of each leg panel has a width of about 14 inches to about 36 inches (preferably about 24 to about 30 inches in this embodiment) and a vertical height of about 20 inches to about 30 inches (preferable about 23 inches to about 24 inches in this embodiment). Each leg panel 130 may have an overall thickness of about 1 inch to about 6 inches (preferable about 3 inches to about 4 inches in this embodiment). Accordingly, in particular embodiments, the width and height of the major surface 132 of the leg panel 130 is substantially greater than the thickness of the leg panel 130. The tabletop 110 may be equipped with one or more access apertures 116 that provide access for cables extending from the upper surface 112 down to one or more corresponding connection ports 156 (FIG. 3) assembled to the base 150. Optionally, the apertures 116 can be fitted with adjustable cover plates to conceal the apertures when not in use.

Referring now to FIG. 2, the leg panels 132 can be adjusted relative to the tabletop 110 and the base 150 so as to perform a number of functions in the process of converting the table 100 from the deployed position (FIG. 1) to the non-deployed position (FIG. 3). For example, as described in more detail below in connection with FIGS. 10-13, each leg panel 130 can be employed to control a corresponding tabletop lock mechanism 160 (FIG. 3) that serves to lock the tabletop 110 in the deployed position (FIG. 1). Thus, in this embodiment, the table 100 is equipped with two leg panels 130 and thereby may provide two independent tabletop lock mechanisms 160 to retain the tabletop 110 in the generally horizontal orientation. The multiple independent tabletop lock mechanisms 160 can provide added safety and reduce the likelihood of the tabletop becoming inadvertently unlocked and moved toward a generally vertical orientation. When the table 100 is prepared for adjustment from the deployed position to the non-deployed position, the movement of each leg panel 132 can be used to adjust the corresponding lock mechanism 160 from a locked position to an unlocked position. As such, the movement of the leg panels 132 adjusts the tabletop 110 from a locked condition to an unlocked condition in which the tabletop 110 can then be pivoted about the generally horizontal axis 115 to adjust the upper surface 112 of the tabletop 110 from the generally horizontal orientation to a generally vertical orientation.

For example, as shown in FIG. 2, a first leg panel 130 can be grasped by a user and pivoted approximately 90-degrees about the corresponding vertical axis 135 such that the first leg panel 130 is arranged generally perpendicularly to a first foot 152 of the base 150. The vertical axis 135 for each leg panel 130 may be defined by a hinge shaft 136 (FIG. 3) extending through each leg panel 130 can connected to bushings inside the base 150. As described in more detail below in connection with FIGS. 10-13, this pivoting motion of the first leg panel 130 can control the corresponding first lock mechanism 160 so as to shift the first lock mechanism 160 from a locked position to an unlocked position. Also, a second leg panel 130 can be grasped by the user and pivoted approximately 90-degrees about the corresponding vertical axis 135 such that the second leg panel 130 is arranged generally perpendicularly to a second foot 152 of the base 150. Here again, this pivoting motion of the second leg panel 130 can control the corresponding second lock mechanism 160 so as to shift the second lock mechanism 160 from a locked position to an unlocked position.

Referring to FIG. 3, in this embodiment, the tabletop 110 is configured to adjust from the generally horizontal orientation to the generally vertical orientation after the leg panels 130 are moved from the first position (FIG. 1) to the second position (FIGS. 2-3). In such circumstances, the table 100 in this embodiment is in the non-deployed position and is configured to be readily moved (e.g., rolled along the floor) or stored. As previously described, the movement of the leg panels 132 (as illustrated, for example, in FIG. 2) adjusts the tabletop 110 from the locked condition to the unlocked condition in which the tabletop 110 can then be pivoted about the generally horizontal axis 115 to adjust the upper surface 112 of the tabletop 110 from the generally horizontal orientation to the generally vertical orientation. The lower surface 114 of the tabletop 110 can be mounted to movable brackets 155 of the base 150, which are hingedly connected to upper arms 154 of the base 150. As such, in this embodiment, the movable brackets 155 and the upper arms 154 of the base 150 can be used to guide the pivoting motion of the tabletop 110 about the generally horizontal axis 115. Optionally, the base 150 may include one or more gas springs 157 coupled to the movable brackets 155 to assist the user in moving the tabletop 110 between the generally horizontal orientation and the generally vertical orientation. Further, the base 150 may include a support beam 158 extending generally horizontally between the upper arms 154, and the base may also include a vertical support member 151 extending between each respective set of the upper arm 154 and the base foot 152.

As described in more detail below, the aforementioned movement of the tabletop 110 between the generally horizontal orientation and generally vertical orientation can cause a number of additional functions to be performed by the table 100. For example, when the tabletop 110 is adjusted from the generally horizontal orientation to the generally vertical orientation (FIG. 3), a brake mechanism 140 (FIGS. 6-9) may be shifted to a disengaged position so that the table 100 is permitted to roll along the floor. In another example, when the tabletop 110 is adjusted from the generally horizontal orientation to the generally vertical orientation (FIG. 3), each of the leg panels 130 may be shifted to an increased height (FIG. 28) for purposes of, for example, providing additional clearance space for nesting multiple tables in stored positions.

Accordingly, the leg panels 130 and the tabletop 110 can be moved as shown in FIGS. 1-3 so as to readily and safely adjust the table 100 between the deployed position (FIG. 1) and the non-deployed position (FIG. 3). When the table 100 is in the deployed position, the table 100 may provide an aesthetic appearance that can conceal a number of movable mechanical components employed in the process of adjusting the table system between the deployed position and the non-deployed position. As such, some embodiments of the table 100 may be suitable for use in a flexible space in which there may be a reason to promptly deploy or store the table 100.

Referring now to FIGS. 4-9, some embodiments of the table 100 can include one or more brake mechanisms 140 that are selectively controlled to inhibit movement of the table 100 when it is in the deployed position. For example, the brake mechanism 140 may be in the form of a floor brake that engages the floor surface 105 when tabletop 110 is in the horizontal orientation (refer to FIGS. 4 and 6-7) and that disengages the floor surface 105 when the table top is shifted to the vertical orientation (refer to FIGS. 5 and 8-9). Accordingly, when the table 100 is in the deployed position, the one or more brake mechanisms 140 can frictionally engage the floor surface 105 in a manner that inhibits movement of the table base 150 relative to the floor surface 105, thereby providing an additional safety benefit by reducing the likelihood of the table 100 being inadvertently moved across the floor when is use in the deployed position. Furthermore, in response to the tabletop 110 being shifted to the vertical orientation, the one or more brake mechanisms 140 can be moved to a disengaged position in an automatic manner (e.g., without user intervention at each brake). As such, the table can be conveniently moved over the floor surface 105 (e.g., rolling along wheels 159 which are casters in this embodiment) when the table 100 is adjusted to the non-deployed position.

Figure 4:
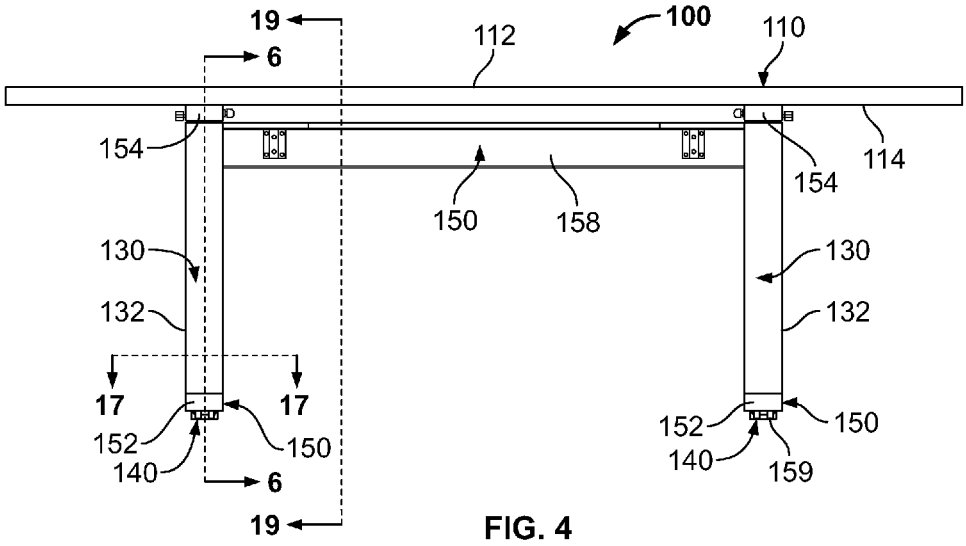
FIG. 4 is a side view of the adjustable table of FIG. 1 in the deployed position.
Figure 5:
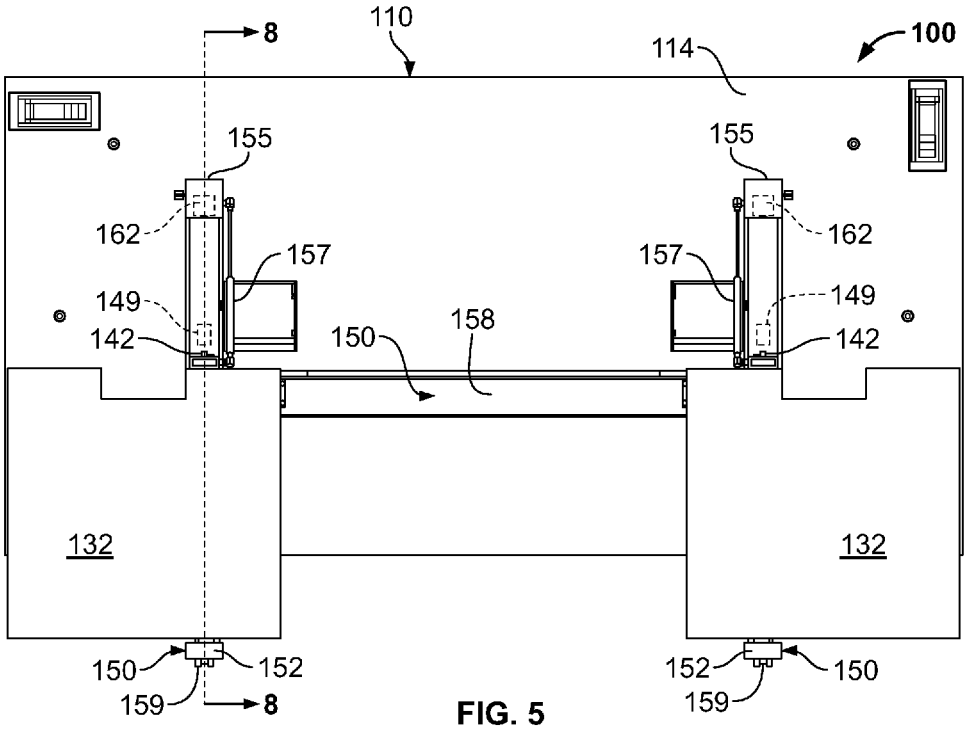
FIG. 5 is a side view of the adjustable table of FIG. 3 in the non-deployed position.
Figure 6:
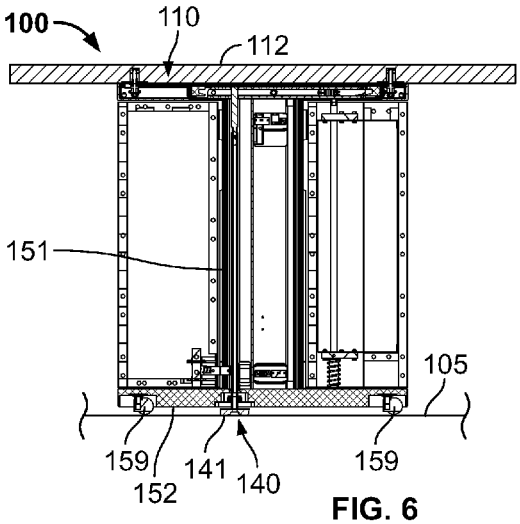
FIG. 6 is a cross-sectional view of the adjustable table of FIG. 4.
Figure 8:
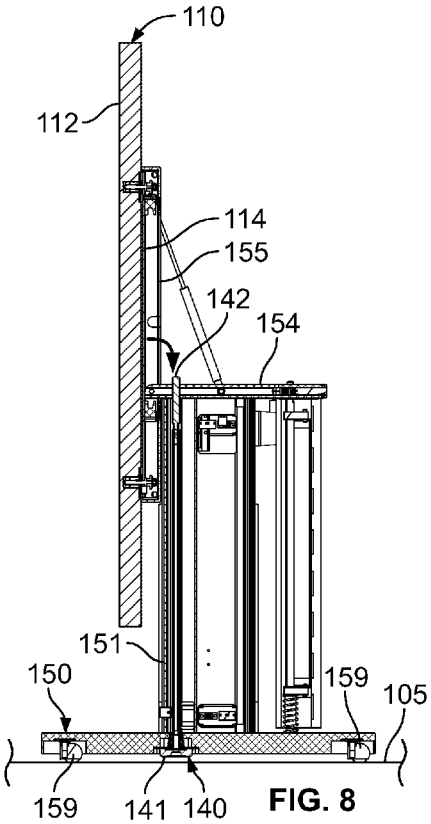
FIG. 8 is a cross-sectional view of the adjustable table of FIG. 5.

FIGS. 4-5 show side views of the table 100 in the deployed position (FIG. 4) and the non-deployed position (FIG. 5), and FIGS. 6 and 8 are cross-sectional views that illustrate the operation of the brake mechanism 140 in one of the legs of the table 100 when in the deployed position (FIG. 6) and the non-deployed position (FIG. 8). In this embodiment, the brake mechanism 140 is spaced apart from the wheels 159 of the table base 150 and does not physically act upon or engage with the wheels 159. The brake mechanism 140 in this embodiment employs a grip pad 142 that is movably coupled to the base 150 so as to shift between an engaged position (in which the grip pad 141 frictionally engages the floor surface 105) an a disengaged position (in which the grip pad 141 is moved away from the floor surface 105). The grip pad 141 may comprise an elastomeric material that provides a secure frictional engagement with the carpeted or hard floor surface 105 so that the table 100 is secured in a desired position on the floor 105 when the grip pad 142 is in the engaged position.

Referring to FIGS. 6-9, some embodiments of the brake mechanism 140 can include an actuation member 142 that is coupled to the grip pad 141 to thereby cause movement of the grip pad 141. In this embodiment, the actuation member 142 is biased to extend partially upward (FIGS. 8-9) from the upper arm 154 of the base 150 so that the actuation member 142 is exposed to the movable bracket 155 connected to the lower surface 114 of the tabletop 110. When the tabletop 110 is moved downward from the generally vertical position (FIGS. 8-9) to the generally horizontal position (FIGS. 6-7), the tabletop 110 applies a downward force upon the actuation member 142 (via the bracket 155 to the lower surface 114 of the tabletop 110), thereby driving the grip pad 141 of the brake mechanism downwardly toward the floor surface 105. The actuation member 142 can comprise an assembly of components that transfer the downward force from the tabletop 110 to the grip pad 141 to the thereby achieve the brake engagement between the grip pad 141 and the floor surface 105. In alternative embodiments, the actuation member 142 may include a single continuous rod that extends through the entire vertical support member 151 of the base 150. Moreover, in some embodiments, each of the vertical supports 151 of the table 100 (two vertical supports 151 in this embodiment) may include a corresponding brake mechanism 140 extending therethrough. Accordingly, in those embodiments, the table 100 can be equipped with multiple brake mechanisms 14*a* long different portions of the base 150 that are contemporaneously actuated by the motion of the tabletop 110.

Figure 7:
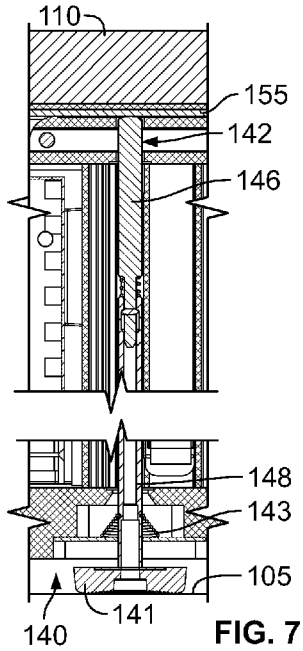
FIG. 7 is an enlarged cross-sectional view of particular components of the adjustable table of FIG. 6.
Figure 9:
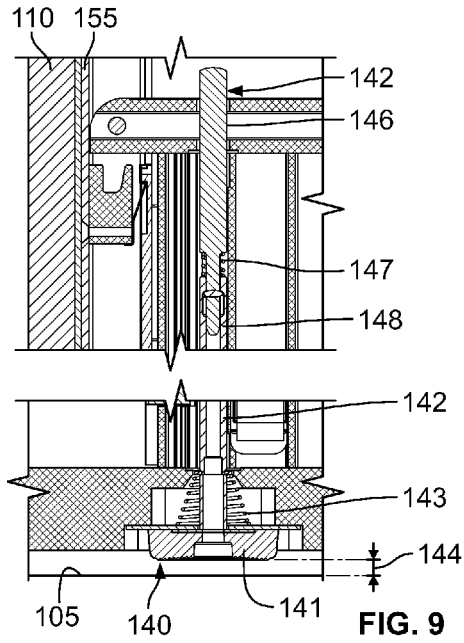
FIG. 9 is an enlarged cross-sectional view of particular components of the adjustable table of FIG. 8.

As shown in FIGS. 7 and 9, the brake mechanism 140 can include a bias spring 143 that is coupled to the actuation member 142, for example, by a retainer ring. The bias spring 143 can be used to bias the actuation member 142 (and the grip pad 141 coupled thereto) in an upward direction away from the floor surface 105. When the tabletop 110 is in the generally vertical orientation (FIGS. 8-9) such that it does not act up the actuation member 142, the bias spring 143 can urge the brake mechanism 140 to an upward position. In the upward position, the grip pad 141 may be spaced apart from the floor surface 105 by a vertical gap 144, and an upper portion of the actuation member 142 protrudes upward from the upper arm 154 of the base 150 so that the upper portion of the actuation member 142 is exposed to exposed to the movable bracket 155 connected to the lower surface 114 of the tabletop 110. When the tabletop 110 is moved downward from the generally vertical position (FIGS. 8-9) to the generally horizontal position (FIGS. 6-7), the lower surface 114 of the tabletop 110 applies a downward force upon the actuation member 142 (via the bracket 155 to the lower surface 114 of the tabletop 110), which overcomes the bias of the spring 143 (e.g., compresses the spring 143 between the retainer ring on the actuation member and a lower base plate on the foot 152) and thereby moves the grip pad 141 downwardly toward the floor surface 105.

Still referring to FIGS. 7-9, in this embodiment of the brake mechanism, the actuation member 142 includes an upper rod 146 that slides within a bushing proximate to the upper arm 154 of the base, a lower rod 148 that slides within another bushing near the foot 152 of the base 150, and a relief spring 147 coupled there between. The relief spring 147 can be used to account for different variations in floor height (e.g., carpeted versus hard flooring) and to at least partially control the downward brake force applied to the grip pad 141. For example, when the upper rod 146 of the actuation member 142 is moved downward in response to the tabletop 110 being lowered and the grip pad 142 engages the floor surface 105, at least a portion of the upper rod 146 may telescope within the lower rod 148 while the relief spring 147 is compressed therebetween. In such circumstances, the relief spring 147 permits some degree of variation in the downward movement of the grip pad 141 even when the amount of downward movement of the upper rod 146 is generally consistent.

Accordingly, some embodiments of the table 100 can include one or more brake mechanisms 140 that are selectively controlled to inhibit movement of the table 100 when it is in the deployed position. Also, when the table 100 is adjusted to the non-deployed position, the one or more brake mechanisms 140 can be configured to automatically disengage so as to permit a user to conveniently roll the table 100 along the floor surface 105.

In some optional embodiments, the table 100 can be equipped with structures that permit the user to select whether each brake mechanism 140 should be automatically engaged when the tabletop 110 is lowered. For example, each brake mechanism 140 can be associated with a user-actuated lever that dictates whether the brake is activate (e.g., capable of automatically shifting between the disengaged and engaged positions as described) or inactive (e.g., remains in a disengaged position regardless of whether the tabletop 110 is raised or lowered). In one option illustrated in FIG. 5, the movable bracket 155 and the lower surface 114 of the tabletop 110 can include optional cavities 149 to receive the upper portion of the actuation member 142 that protrudes above the upper arm 154 of the base 150. Each of the optional cavities 149 can be equipped with a slidable lever to move a cover plate over the cavity 149. In such circumstances, a user could actuate the lever to cover the cavities 149, in which case the brake mechanism 140 would be activated and the actuation member 142 and the grip pad 141 would automatically shift positions in response to the adjustment of the tabletop 110 (as described above). Also, the user could actuate the lever so that the cavities 149 are exposed, in which case the brake mechanism 140 would be inactive because the actuation member 142 would be received into the corresponding cavity 149 when the tabletop 110 is lower to the generally horizontal orientation. As such, the actuation member 142 would not automatically move in response to the tabletop 110 being lower, and the brake mechanism 140 would remain in the disengaged position.

Referring now to FIGS. 10-13, some embodiments of the table 100 can include one or more lock mechanisms 160 that are selectively controlled to lock the tabletop 110 in the generally horizontal orientation (refer to FIG. 1). As previously described, each lock mechanism 160 can be shifted between a locked position and an unlocked position in response to movement of a corresponding one of the leg panels 130. As such, the table 100 can be equipped with multiple locking mechanisms 160 that retain the tabletop 110 in the generally horizontal position until a user moves the leg panels 130 as part of the process for adjusting the table 100 the to the non-deployed position.

Figure 10:
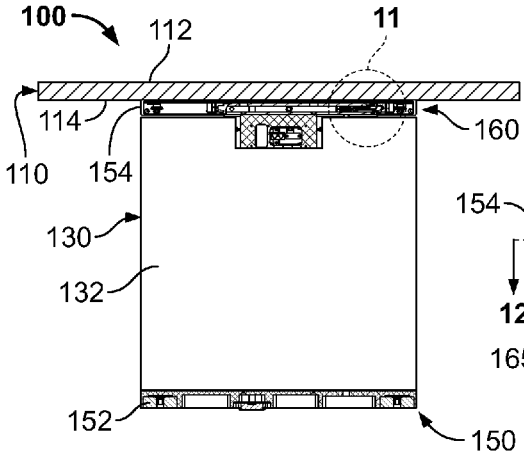
FIG. 10 is a cross-sectional view of the adjustable table of FIG. 1.
Figure 11:
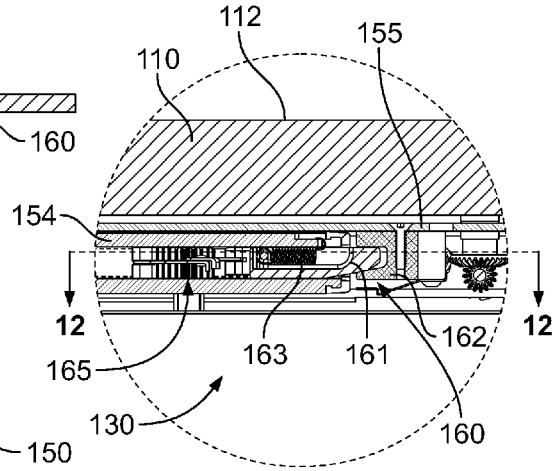
FIG. 11 is an enlarged cross-sectional view of a portion of the adjustable table of FIG. 10.

FIG. 10 is a cross-sectional side view of a portion of the table 100 of FIG. 1, and FIG. 11 is an enlarged view of the lock mechanism 160 illustrated in FIG. 10 (with the lock mechanism 160 illustrated in the locked position). In this embodiment, each lock mechanism 160 includes movable lock member 161 that can adjust positions relative to a catch plate 162. The movable lock member 161 is mounted in the upper arm 154 of the base 150 while the catch plate 162 is mounted in a portion of the movable bracket 155 (refer also to FIGS. 3 and 5 showing the location of the catch plate 162). As such, when the tabletop 110 is adjusted to the generally horizontal position, the upper arm 154 of the base 150 and the movable bracket 154 are adjacent to one another so as to align the movable lock member 161 with the catch plate 162.

Referring to FIG. 11, the movable lock member 161 can include a wedge surface that mates with a complementary wedge cavity of the catch plate 162. When the movable lock member 161 slides into engagement with the catch plate 162, the lock mechanism 160 is in the locked position and the movable bracket 155 (with the tabletop 110 attached thereto) is restrained from moving upward away from the upper arm 154 of the base 150. As described in more detail below in connection with FIG. 13, the movable lock member 161 can be retracted away from the catch plate 162 in response to movement of the leg panel 130. When the lock member 161 is retracted into the upper arm 154 of the base and away from the catch plate 162, the movable bracket 155 (with the tabletop 110 attached thereto) is no longer restrained by the lock mechanism 160.

Figure 12:
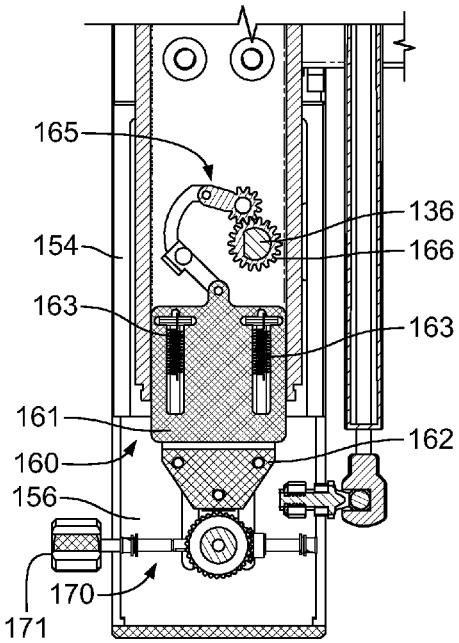
FIG. 12 is a top cross-sectional view of the portion of the adjustable table of FIG. 11, with a tabletop lock member in a locked position.
Figure 13:
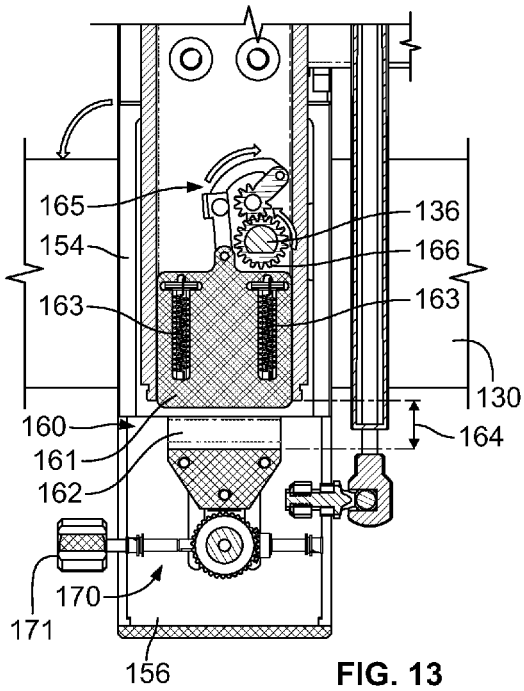
FIG. 13 is a top cross-sectional view of the portion of the adjustable table of FIG. 11, with the tabletop lock member in an unlocked position.

Referring now to FIGS. 12-13, in some embodiments of the lock mechanism 160, the movable lock member 161 can move in a generally linear path in response to movement the leg panel 130. For example, the movable lock member 161 can travel a linear distance 164 from the locked position (FIG. 12) to the unlocked position (FIG. 13). The lock mechanism 160 may include one or more bias springs 163 that act upon the movable lock member 161 so as to urge the lock member into the locked or unlocked positions. In this embodiment, the bias springs 163 are tension springs that urge the lock member 161 toward the locked position (e.g., toward the catch plate 162). The lock mechanism 160 may also include a gear system 165 that urges the movable lock member 161 to move in the linear path in response to movement of the leg panel 130. For example, in this embodiment, the gear system 165 includes a spur gear 166 that is fixed to the hinge shaft 136 of the corresponding leg panel 130. In particular, the hinge shaft 136 can be keyed so that the spur gear 166 rotates together with the hinge shaft 136 and the corresponding leg panel 130. The gear system 165 can include other gears, linkages, or a combination thereof so as to translate the rotational motion of the hinge shaft 136 of the leg panel 130 into the linear motion of the movable lock member 161.

Thus, as shown in the embodiment depicted in FIG. 13, when the leg panel 130 is pivoted to the second position (as also illustrated in FIG. 2), the hinge shaft 132 is likewise rotated. In response to the rotation of the hinge shaft 132, the gear system 165 of the lock mechanism 160 applies a force to the movable lock member 161 that overcomes the bias of the spring 163 and causes the movable lock member to retract away from the catch plate 164. When the movable lock member 161 has shifted by the linear distance 164, the movable lock member 161 no longer interferes with the catch plate 162, and the lock mechanism 160 is in the unlocked position.

When each of the lock mechanisms 160 is shifted to the unlocked position (by moving the leg panels 130 to the second position as shown in FIG. 2), the tabletop 110 is in an unlocked condition so that a user can adjust the tabletop 110 from the generally horizontal orientation to the generally vertical orientation.

Figure 14:
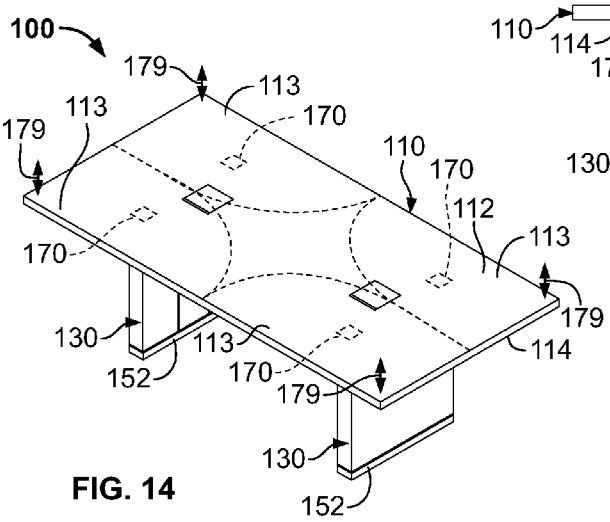
FIG. 14 is another perspective view of the adjustable table of FIG. 1.
Figure 15:
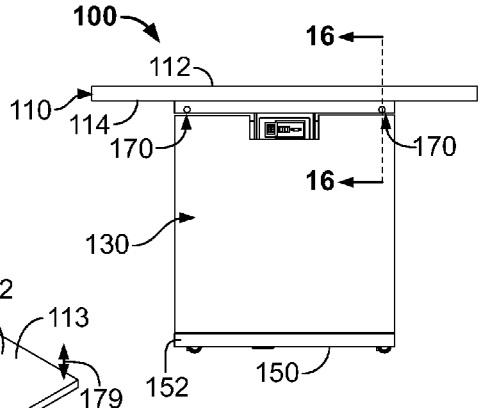
FIG. 15 is a side view of the adjustable table of FIG. 14.
Figure 16:
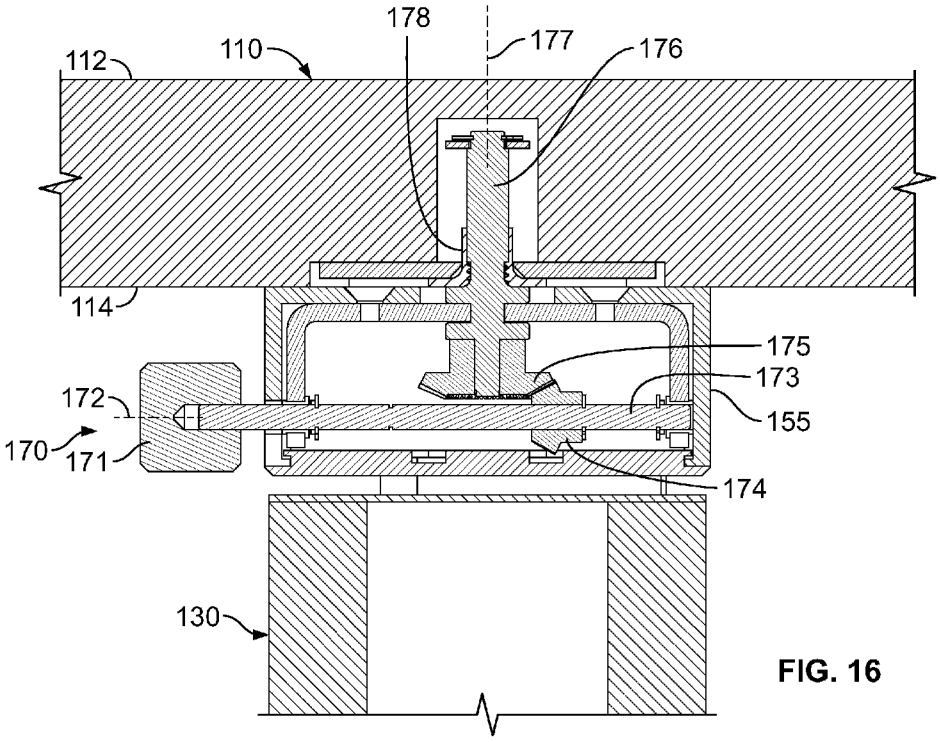
FIG. 16 is an enlarged cross-sectional view of a portion of the adjustable table of FIG. 15.

Referring now to FIGS. 14-16, some embodiments of the table 100 can be equipped with a plurality of tabletop leveling mechanisms 170 mounted proximate to the lower surface 114 of the tabletop 110. In particular embodiments, the leveling mechanisms 170 are not mounted near the floor but are instead near the tabletop 110, so the upper surface 12 of the tabletop 110 can be conveniently leveled by a user standing near the tabletop 110 without the need to sit or kneel on the floor. Optionally, the upper surface 12 of the tabletop 110 can be leveled by a user while the user's eye level is near the tabletop surface (rather than the user's head being located completely underneath the tabletop 110 while reaching toward the floor).

As shown in FIG. 14, this embodiment of the table 100 includes four leveling mechanisms 170 mounted proximate to the lower surface 114 of the tabletop 110 such that each of the four leveling mechanisms 170 is mounted in a position vertically closer to the lower surface 114 of tabletop 110 than to the base foot 152. Each of the four leveling mechanisms 170 may be configured to at least partially control a height adjustment 179 of a respective corner 113 of the upper surface 112 of the tabletop 110. For example, in some embodiments, the four leveling mechanisms 170 can provide the user with the ability to level each of the four corners 113 in a generally independent manner. Accordingly, the upper surface 112 of the tabletop 110 can be substantially aligned with a neighboring upper surface of a neighboring table in circumstances when a group of tables 100 are ganged together (refer, for example, to FIG. 21).

Referring to FIGS. 15-16, in this embodiment, the leveling mechanisms 170 are positioned along the movable brackets 155 attached to the lower surface 114 of the tabletop 110 (refer also to FIG. 3). In particular, each end of the two movable brackets 155 is equipped with a respective leveling mechanism 170 so that the table 100 includes four leveling mechanisms mounted proximate to the lower surface 114 of the tabletop 110. A shown in FIG. 16, each of the leveling mechanisms 170 includes an adjustment knob 171 that is accessible by a user's hand in a region immediately under the lower surface 114 of the tabletop 110. The knob 171 can be rotated about a generally horizontal axis 172 so as to adjust the upper surface 112 of the tabletop 110 in a generally vertically direction (refer, for example, to adjustment 179 in FIG. 14). In this embodiment, the knob 171 is coupled to a generally horizontal shaft 173 and a first beveled gear 174. The generally horizontal shaft 173 and the corresponding axis 172 may extend generally parallel to the lower surface 114 and the upper surface 112 of the tabletop 110. In response to rotation of the knob 171, the first beveled gear 174 rotates about the axis 172 and urges rotation of a second beveled gear 175. The second beveled gear 175 is fixed to a generally vertical shaft 176, which has an exterior thread pattern along at least a portion of the shaft 176. The threads of the generally vertical shaft 176 mate with threads of a cylinder of a mounting plate structure 178 attached to the lower surface 114 of the tabletop 110. When the shaft 176 is rotated about a generally vertical axis 177 (in response to rotation of the knob 171, the first shaft 173, and the gears 174 and 175), the threads of the shaft 176 engage with the mating threads of the mounting plate structure 178 to thereby urge the mounting plate structure 178 (and the corresponding corner region 113 of the tabletop 110) to move in a generally vertical direction. Accordingly, the leveling mechanism 170 permits a user to conveniently grasp and rotate the knob 171 located near the tabletop 110 so as to manually select the height adjustment of the corresponding corner 113 of the tabletop 110. Moreover, because the knob 171 rotates about the horizontal axis 172 while causing the generally vertical height adjustment 179, the leveling mechanism 170 can remain substantially concealed near the lower surface 114 of the tabletop 110 (without requiring a knob that extends vertically downward below the tabletop 110).

Figure 17:
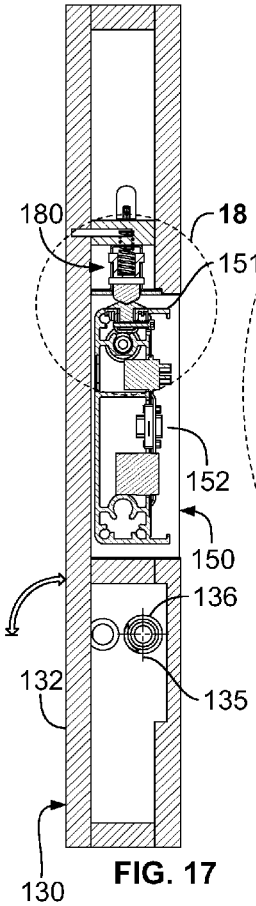
FIG. 17 is a cross-sectional view of a leg assembly of the adjustable table of FIG. 4.
Figure 18:
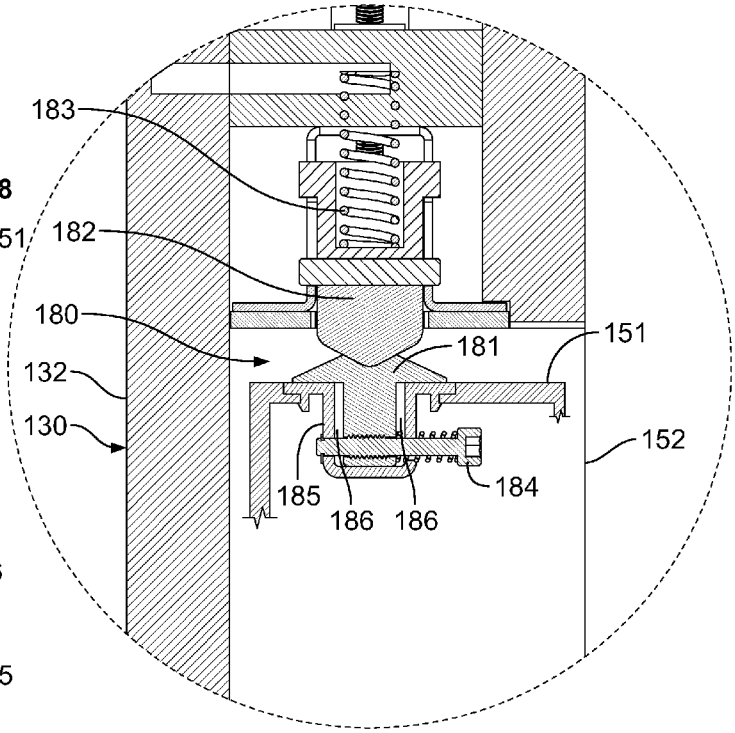
FIG. 18 is an enlarged cross-sectional view of a portion of the adjustable table of FIG. 17.

Referring now to FIGS. 17-20, some embodiments of the table 100 can be equipped with an adjustable catch mechanism 180 for releasably securing the leg panel 130 with the base 150 in the first position (as shown in FIGS. 1 and 4). FIG. 17 shows a cross-sectional view of one of the leg assemblies of the table 100 of FIG. 4, which includes the vertical support member 151 of the base 150 and the leg panel 130 that is positioned to be substantially aligned with the vertical support member 151 in a side-by-side configuration. FIG. 18 shows an enlarged view of the adjustable catch mechanism 180 illustrated in FIG. 19. As previously described, the leg panel 130 can be pivoted about the generally vertical axis 135 (as defined by the hinge shaft 136 in this embodiment) so as to shift between the first position (depicted in FIG. 18 and also in FIGS. 1 and 4) and the second position (depicted in FIG. 2). When the leg panel 130 is arranged in the first position, the leg panel 130 may be generally aligned with the base foot 152 while substantially surrounding several sides of the vertical support member 151 of the base 150 (as shown in FIGS. 1 and 4. The adjustable catch mechanism 180 can be employed to releasably secure the leg panel 130 in the aforementioned first position so as to maintain the table 100 in the deployed position until a user selects otherwise. Furthermore, because the leg panel 130 may comprise a wood material while the foot base 152 and the vertical support member may comprise a metal material, a number of factors may cause the leg panel 130 to be out of alignment with the foot 152 and the vertical support member 151 when it is closed toward the first position. As such, the positioning of catch mechanism 180 relative to the base 150 can be adjusted by a user after the table 100 is deployed so as to facilitate a selected alignment between the leg panel 130 and the base 150.

As shown in FIGS. 17-18, some embodiments of the adjustable catch mechanism 180 may include a striker 181 having a detent configured to mate with plunger device 182. In this embodiment, the striker 181 is adjustably mounted to the vertical support member 151 of the base 150 while the plunger device 182 is mounted to the leg panel 130. As such, when the leg panel 130 is pivoted about the generally vertical axis 135, the plunger device 182 also moves with the leg panel 130. The plunger device 182 can be biased by a spring member 183 of the catch mechanism 180, which urges the plunger device 182 into mating engagement with the detent of the striker 181. When the leg panel 130 is pivoted away from the vertical support member 151 (as illustrated in FIG. 2), the plunger device 182 can be shifted slightly away from the striker 181 so as to compress the spring member 183 while the plunger device 182 is freed from the striker 181. When the leg panel 130 is pivoted toward the vertical support member 151 (as illustrated in FIGS. 1 and 4), the plunger device 182 again mates with the striker 181 while the bias spring 183 urges the plunger device 182 to be releasably retained by the striker 181.

In some circumstances, the position of the catch mechanism 180 can be adjusted so as to provide a selected alignment between the leg panel 130 and the base 150. In this embodiment, the catch mechanism 180 includes an adjustment screw 184 that can be accessed by a user after the table 100 is deployed (as shown in FIGS. 1 and 4). The adjustment screw 184 can be rotated by a user to adjust the position of the striker 181 relative to the base 150 (e.g., relative to the vertical support member 151 in this embodiment). For example, the adjustment screw 184 can be rotated to linearly move the striker 181 relative to a fixed channel member 185. The fixed channel member 185 is assembly to the vertical support member 151, and provides a side-to-side clearance space 186 for adjustable movement of the striker 181. Accordingly, when the adjustment screw 184 is rotated, the threads of the adjustment screw 184 mate with corresponding threads of the striker 181 so as to urge the striker 181 to move linearly in the clearance space 186 to a new position. When the striker 181 is moved to a new position, the plunger device 182 can mate with the striker 181 so as to provide a new position of the leg panel 130 relative to the base 150. Thus, the adjustment screw 184 can shift the position of the striker, which in turn may provide a selected alignment between the leg panel 130 and the base 150.

Figure 19:
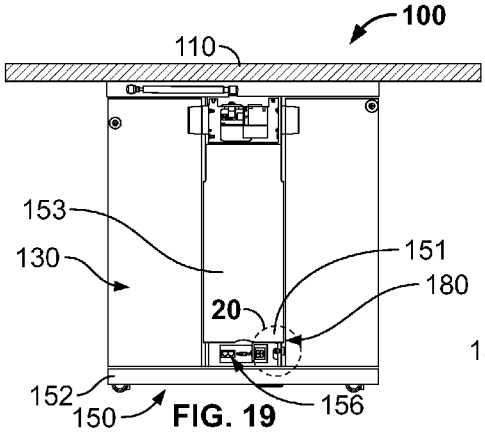
FIG. 19 is a side cross-sectional view of the adjustable table of FIG. 4.
Figure 20:
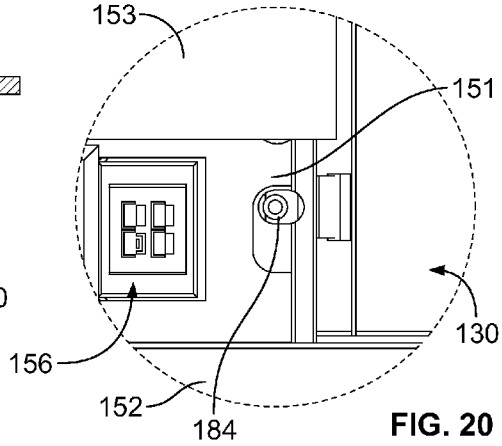
FIG. 20 is an enlarged cross-sectional view of a portion of the adjustable table of FIG. 19.

As shown in FIGS. 19-20, in some embodiments, the adjustment screw 184 of the catch mechanism 180 can be generally concealed behind a slider panel 153 on the vertical support member 151. For example, the slider panel 153 can be moved upward from a base position so as to expose the adjustment screw 184. In addition, the slide panel 153 can be moved upward to provide access to additional power and data connection ports 156 located on the base 150 near the floor.

Figure 21:
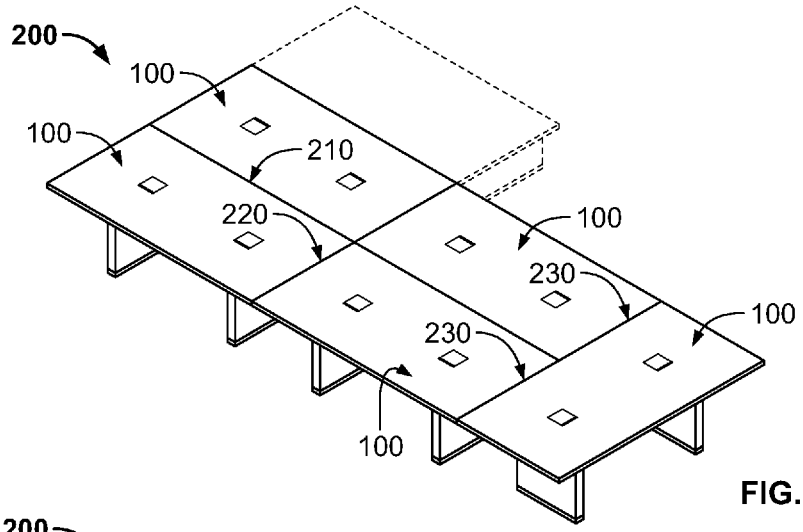
FIG. 21 is a perspective view of a system including a plurality of the adjustable tables of FIG. 1 coupled together, in accordance with some embodiments.
Figure 22:
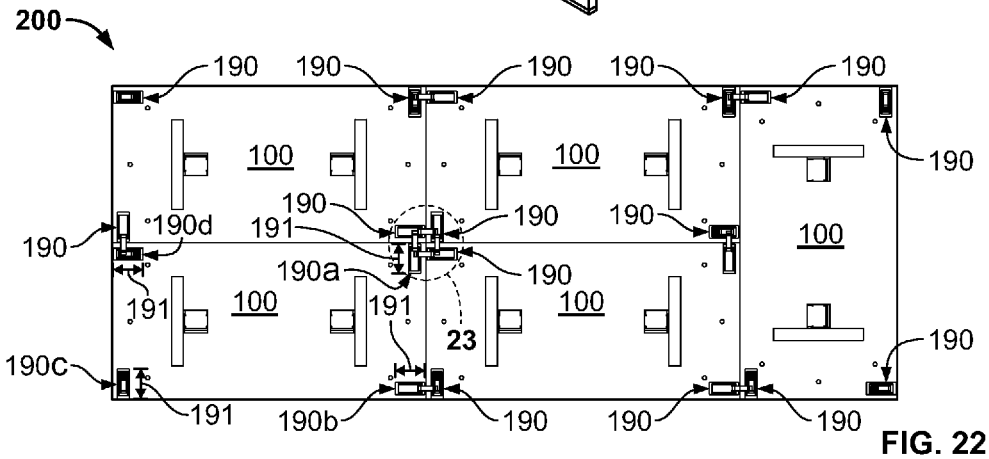
FIG. 22 is a bottom view of the system of FIG. 21.

Referring now to FIGS. 21-25, some embodiments of the table 100 can be employed in a system in which a plurality of the tables 100 are coupled together so form a larger table construct. In particular embodiments, each of the tables 100 can be equipped with a plurality of gang mechanisms 190 that are incorporated into the underside of the tabletop 110. As shown in FIGS. 21-22, the gang mechanisms 190 permit the user to gang together the tables 110 in any of a parallel arrangement 210 in which the longest length of the neighboring tables 100 are positioned side-by-side, a longitudinal arrangement 220 in which the shorter widths of the neighboring tables are positioned side-by-side, and a perpendicular arrangement 230 in which the shorter width of one table 100 is positioned side-by-side with a longer length of the neighboring table 100.

Figure 23:
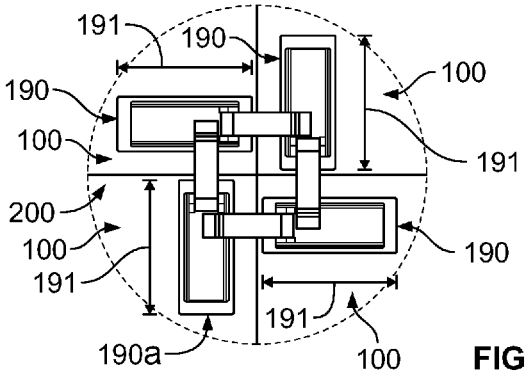
FIG. 23 is an enlarged bottom view of a portion of the system of FIG. 22.

Referring to FIGS. 22-23, in some embodiments, each table 100 is equipped with a plurality of the gang mechanisms 190. For example, one gang mechanism 190 may be assembled into a cavity in the lower surface 114 of the table 100 at each of the four corners. In this embodiment, the gang mechanism 190 incorporated into each table 100 is arranged in different orientation relative to the neighboring gang mechanism. For example, each gang mechanism 190 can have a longitudinal length 191 (FIG. 23) that is the maximum dimension of the gang mechanism. As shown in FIG. 22, the longitudinal length of a first gang mechanism 190*a* assembled to a first corner of the table 100 is oriented generally perpendicularly to the longitudinal length of each of the neighboring gang mechanisms 190*b* and 190*d* assembled to the neighboring two corners of the table 100. Accordingly, each gang mechanism 190 mounted into the tabletop 110 is oriented perpendicularly to each of the two nearest gang mechanisms 190 also mounted into the tabletop 110. Such a configuration of the gang mechanism 190 can permit each table 100 to gang with a neighboring table 100 (or a plurality of neighboring tables 100) in any of the parallel arrangement 210, the longitudinal arrangement 220, and the perpendicular arrangement 230 (as described above).

Figure 24:
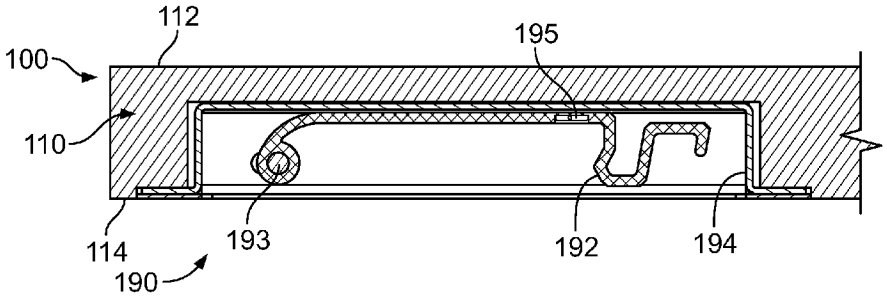
FIG. 24 is a cross-sectional view of a gang mechanism of a table of the system of FIG. 21, with the gang mechanism being in a first position in accordance with some embodiments.
Figure 25:
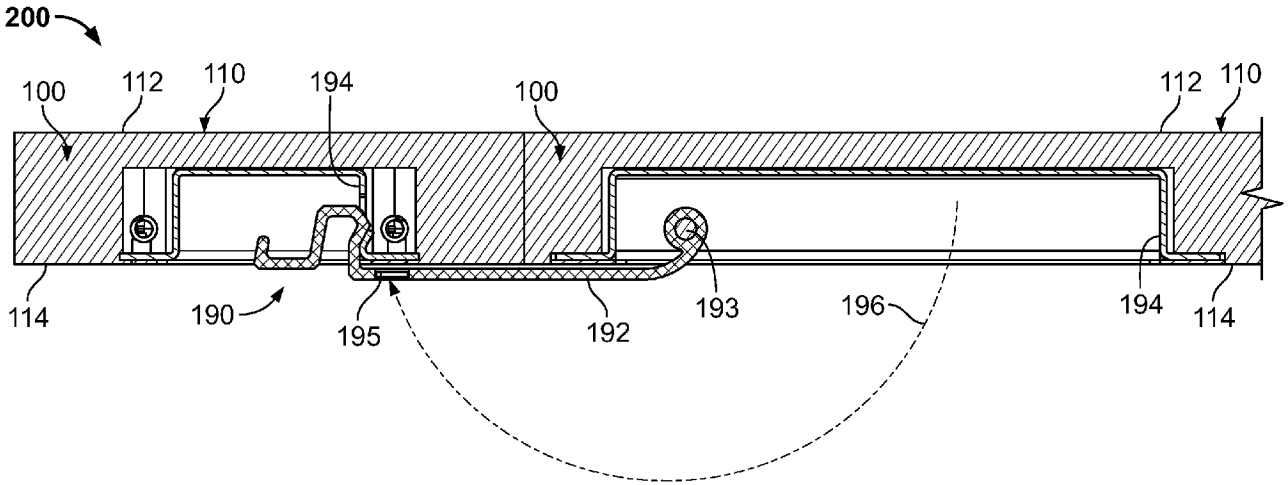
FIG. 25 is a cross-sectional view of the gang mechanism of the table of FIG. 25, with the gang mechanism being in a second position in accordance with some embodiments.

Referring now to FIGS. 24-25, in some embodiments, each of the gang mechanisms 190 are assembled into the table 100 so that the gang mechanisms 190 remain with the table 100 and are conveniently accessible to the user. In this embodiment, each gang mechanism 190 includes a movable member 192 in the form of a latch that is pivotable about a pin 193. The latch 192 can be arranged in a mounting plate 194 of the gang mechanism 190 that defines cavity larger than the latch 192. When the latch 192 is in a first position (FIG. 24), the latch 192 resides fully within the cavity of the mounting plate 194. The mounting plate 194 of the gang mechanism 190 is mounted into a cavity formed in the lower surface 114 of the tabletop 110 and has a depth that is less than the thickness of the table top 110. As such, the gang mechanism 190 can be mounted to the tabletop 110 such that the entire gang mechanism resides at or above the lower surface 114 of the tabletop 110 when the gang mechanism 190 is in the first position (FIG. 24).

In this embodiment, the latch 192 of the gang mechanism 190 is retained in the first position by a magnetic force between first magnetically attractive component of the latch 192 and a second magnetically attractive component of the mounting plate 194. For example, as shown in FIG. 24, the latch 192 can be equipped with the first magnetically attractive component in the form of a permanent magnet device 195, which is drawn toward the second magnetically attractive component in the form of a magnetically attractive metal surface of the mounting plate 194. As such, when the gang mechanism 190 is not in use, the gang mechanism 190 remains concealed above the lower surface 114 of the tabletop 110 while the latch 192 is retained in the first position (FIG. 24) by a magnetic force.

Referring to FIG. 25, the user can adjust the gang mechanism 190 to engage with a neighboring table 100 by moving the latch 192 away from the first position and toward a nearby gang mechanism 190 of the neighboring table 100. In this embodiment, the latch 192 is pivotable about the pin 193, and thus the gang mechanism is provided with only a single degree of freedom in which the latch 192 moves in a pivoting path 196. In particular embodiments, both the latch 192 and the pivoting path 196 extend in a plane that is generally parallel to the longitudinal length 191 (and maximum dimension) of the gang mechanism 190. As shown in FIG. 25, the latch 192 can have a distal end that is configured to mate with a sidewall of the mounting plate 194 of the nearby gang mechanism 190 of the neighboring table 194. Thus, the latch 192 provides a mating engagement between the gang mechanisms 190 of the neighboring tables 100 so that the tables 100 are secured in one of the aforementioned arrangements. Furthermore, the user can grasp the latch 192 and move it away from the mounting plate 194 of the nearby gang mechanism 190 of the neighboring table 194 so as to readily disengage the neighboring tables 100. The latch 192 can be returned to the first position (FIG. 24) in which the magnetic force retains the latch 192 above the lower surface 114 of the tabletop 110.

Figure 26:
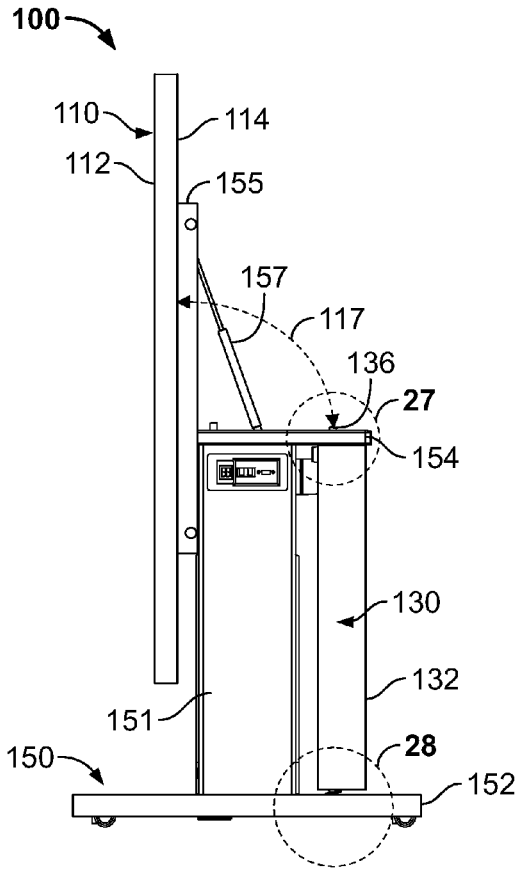
FIG. 26 is a side view of the adjustable table of FIG. 3 in the non-deployed position.
Figure 27:
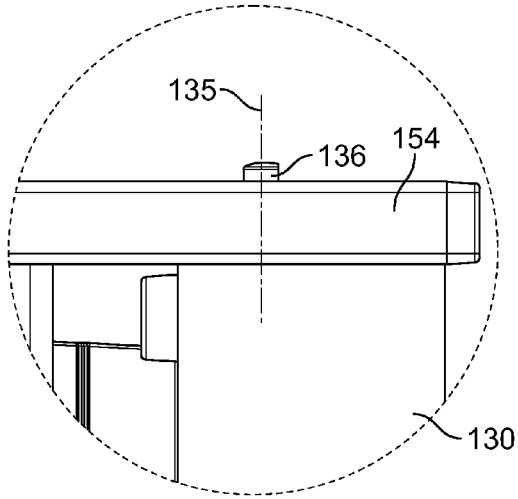
FIG. 27 is an enlarged side view of a portion of the adjustable table of FIG. 26.

Referring now to FIGS. 26-29, some embodiments of the table 100 can be configured to provide additional clearance space for nesting with other tables 100 when the table 100 is adjusted to the non-deployed position. As previously described in connection with FIGS. 1-3, the table 100 can be readily adjusted from the deployed position to the non-deployed position by pivoting the leg panels 130 outward (FIG. 2) and pivoting the tabletop 110 to a generally vertical orientation (FIG. 3). FIG. 26 shows a side view of the table 100 in the non-deployed position. When the table 100 is in the non-deployed position, the hinge shaft 136 (FIG. 27) of the leg panel 130 may be biased to protrude above the upper arm 154 of the base 150. In particular, the leg panel 130 may be equipped with a spring 137 (FIG. 28) that biases the leg panel 130 and the hinge shaft 136 upwardly away from the base foot 152. When the tabletop 110 is moved downwardly to the generally horizontal orientation (FIG. 1), the movable bracket 155 (and the tabletop 110 connected thereto) is configured to move in path 117 (FIG. 26) to apply a downward force upon the portion of the hinge shaft 136 that protrudes above the upper arm 154. In doing so, the hinge shaft 136 and the leg panel 130 are shifted together in a downward motion so as to compress the spring 137. This downward motion causes the leg panel 130 to reside only slightly above the foot base 152 (e.g., less than ¼ inch in this embodiment).

Figure 28:
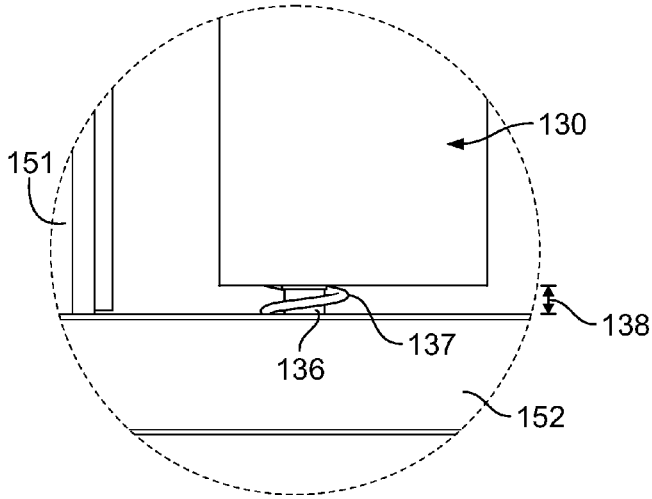
FIG. 28 is an enlarged side view of another portion of the adjustable table of FIG. 26.

When the tabletop 110 is moved away from the base 150 and toward the generally vertical orientation (FIG. 26), the spring 137 acts to raise the leg panel 130 (and the hinge shaft 137 coupled thereto) by a vertical displacement 138 (FIG. 28). As such, each of the leg panels 130 and 132 are biased to automatically adjust from a lower vertical height to a higher vertical height (as shown, for example, by the vertical displacement 138 in FIG. 28) in response to the tabletop 110 being pivoted about the generally horizontal axis 115 to adjust the upper surface 112 of the tabletop 110 from the generally horizontal orientation to the generally vertical orientation.

Figure 29:
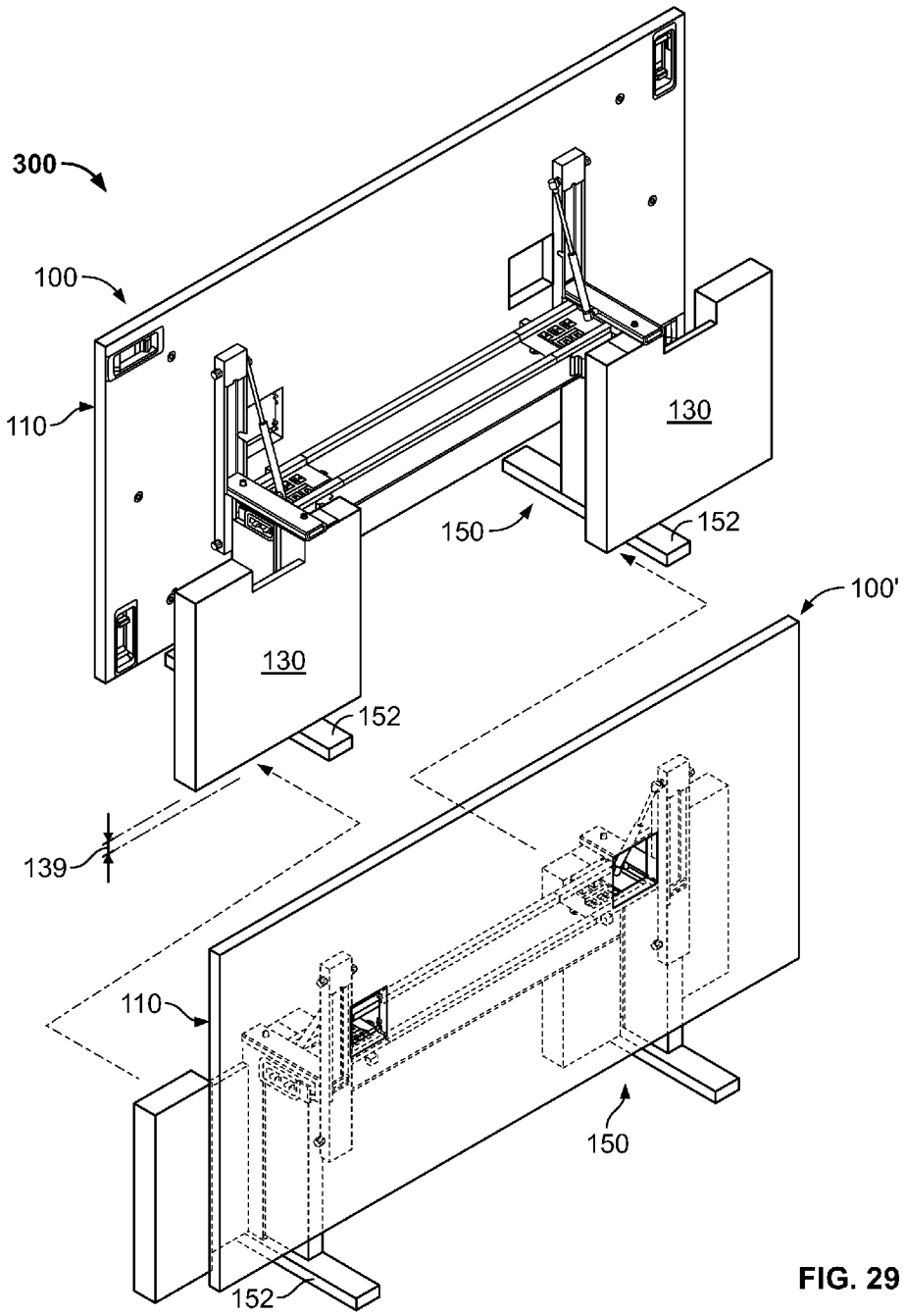
FIG. 29 is a perspective view of a system including a plurality of the adjustable tables of FIG. 26 in a nested configuration, in accordance with some embodiments.

Referring now to FIG. 29, the aforementioned vertical displacement 138 of the leg panels 130 may be useful to provide clearance for a base 150 of a neighboring table 100' when nesting a plurality of tables 100 and 100' together. For example, in some circumstances, the plurality of tables 100 and 100' may rest on a floor surface that is not perfectly even or upon a thick carpet surface in which the tables 100 may settle lower after an extended period of time. In those cases, the leg panels 130 of a first table 100 can be arranged to avoid interfering with the feet 152 of base 150 of the neighboring table 100'. In particular, the vertical height 139 between the floor and the lower edge of the leg panels 130 can be increased (e.g., by about ⅜ inch to about ¾ inch in this embodiment) due to the previously described vertical displacement 138 (FIG. 28). This increased height 139 can be used to provide ample clearance for the feet 152 of the base 150 of the neighboring table 100' when the first table 100 and the neighboring table 100' are arranged in a nested configuration.

As described herein, some embodiments of table system can include the table 100 that is readily and safely adjustable between the deployed position (FIG. 1) and the non-deployed position (FIG. 3). In particular embodiments, the table system can include a plurality of tables 100 that are each equipped with gang mechanisms 190 to couple the tables 100 in various side-by-side configurations. Furthermore, when the plurality of tables 100 are adjusted to the non-deployed position (e.g., in which the upper surfaces 112 of the tabletops 110 are positioned generally vertical), the neighboring tables 100 can be arranged in a nested configuration to conserve additional space during storage.

A number of embodiments of the invention have been described. Nevertheless, it will be understood that various modifications may be made without departing from the spirit and scope of the invention. Accordingly, other embodiments are within the scope of the following claims.

What is claimed is:

1. A table apparatus, comprising:

a tabletop including an upper surface and a lower surface, the upper surface of the tabletop extending in a generally horizontal orientation when the table apparatus is in a deployed position;

a base coupled to the tabletop and configured to extend from a floor surface and toward the tabletop; and first and second pivotable leg panels extending generally vertically downward away from the lower surface of tabletop when the upper surface of the tabletop is in the generally horizontal orientation, the first pivotable leg panel being pivotable relative to the base about a first generally vertical axis while the upper surface of the tabletop is in the generally horizontal orientation, the second pivotable leg panel being pivotable relative to the base about a second generally vertical axis while the upper surface of the tabletop is in the generally horizontal orientation, wherein pivoting the first and second pivotable leg panels about the first and second generally vertical axes adjusts the tabletop from a locked condition to an unlocked condition, wherein when the tabletop is in the unlocked condition, the tabletop is pivotable about a generally horizontal axis to adjust the upper surface of the tabletop from the generally horizontal orientation to a generally vertical orientation.

2. The table apparatus of claim 1, wherein each of the first and second leg panels have a major surface extending generally vertically and being defined by a panel width and a panel height, the panel width being greater than or equal to half the width of the tabletop, the panel height being greater than the panel width.

3. The table apparatus of claim 1, wherein the base comprises wheels to engage the floor surface, the first leg panel being movably mounted to the base the table apparatus further comprising a first brake mechanism to secure the base in a generally stationary position relative to the floor surface when the tabletop is in the generally horizontal orientation, the first brake mechanism extending at least partially through the base and being spring biased away from the floor surface such that the first brake mechanism is configured to rise away from the floor surface in response to adjustment of the tabletop from the generally horizontal orientation to the generally vertical orientation.

4. The table apparatus of claim 1, further comprising:

a first lock mechanism to retain the tabletop in the generally horizontal orientation, the first lock mechanism being actuated to unlock the tabletop in response to the pivoting motion of the first leg panel; and a second lock mechanism to retain the tabletop in the generally horizontal orientation, the second lock mechanism being spaced apart from the first lock mechanism, the second lock mechanism being actuated to unlock the tabletop in response to the pivoting motion of the second leg panel.

5. The table apparatus of claim 1, wherein the base comprises caster wheels to engage the floor surface, wherein a majority of each caster wheel is concealed from view by feet of the base.

6. The table apparatus of claim 1, further comprising four tabletop leveling mechanisms mounted proximate to the lower surface of the tabletop, each of the four tabletop leveling mechanisms being configured to at least partially control a height adjustment of a respective corner of the tabletop.

7. The table apparatus of claim 1, further comprising a plurality of gang mechanisms mounted proximate to the lower surface of the tabletop such that each of the gang mechanisms resides in a respective cavity in the lower surface of the tabletop, wherein each gang mechanism is adjustable between a non-deployed position in which the entire gang mechanism is retained at or above of the lower surface of the tabletop when the upper surface of the tabletop is in the generally horizontal orientation and a deployed position in which at least a portion of the gang mechanism is configured to couple with another tabletop.

8. The table apparatus of claim 1, further comprising:

an adjustable catch mechanism to secure the first leg panel in a generally aligned orientation with a first vertical support member of the base when the first leg panel is pivoted toward the first vertical support member, the adjustable catch mechanism comprising a first catch component mounted to the first vertical support member such that a position of the first catch component is manually adjustable relative to the first vertical support member.

9. A table apparatus, comprising:

a tabletop including an upper surface and a lower surface, the upper surface of the tabletop extending in a generally horizontal orientation when the table apparatus is in a deployed position, and the tabletop being adjustable about a generally horizontal axis to adjust the upper surface of the tabletop from the generally horizontal orientation to a generally vertical orientation;

a base coupled to the tabletop and configured to extend from a floor surface and toward the tabletop;

first and second pivotable leg panels extending generally vertically downward away from the lower surface of tabletop when the upper surface of the tabletop is in the generally horizontal orientation, the first and second pivotable leg panels each having a major surface extending generally vertically and being defined by a panel width and a panel height, the panel width and the panel height being substantially greater than a panel thickness;

the first pivotable leg panel being pivotable relative to the base about a first generally vertical axis while the upper surface of the tabletop is in the generally horizontal orientation; and the second pivotable leg panel being pivotable relative to the base about a second generally vertical axis while the upper surface of the tabletop is in the generally horizontal orientation.

10. The table apparatus of claim 9, wherein pivoting the first and second pivotable leg panels about the first and second generally vertical axes adjusts the tabletop from a locked condition to an unlocked condition, and wherein when the tabletop is in the unlocked condition, the tabletop is pivotable about a generally horizontal axis to adjust the upper surface of the tabletop from the generally horizontal orientation to the generally vertical orientation.

11. The table apparatus of claim 9, wherein each of the first and second leg panels have a major surface extending generally vertically and being defined by a panel width and a panel height, the panel width and the panel height being substantially greater than a panel thickness.

12. The table apparatus of claim 9, further comprising: the base comprising wheels to engage the floor surface, the first leg panel being movably mounted to the base assembly; and a first brake mechanism to secure the base in a generally stationary position relative to the floor surface when the tabletop is in the generally horizontal orientation, the first brake mechanism being extending at least partially through the base and being spring biased away from the floor surface such that the first brake mechanism is configured to rise away from the floor surface in response to adjustment of the tabletop from the generally horizontal orientation to the generally vertical orientation.

13. The table apparatus of claim 9, further comprising:

a first lock mechanism to retain the tabletop in the generally horizontal orientation, the first lock mechanism being actuated to unlock the tabletop in response to the pivoting motion of the first leg panel; and a second lock mechanism to retain the tabletop in the generally horizontal orientation, the second lock mechanism being spaced apart from the first lock mechanism, the second lock mechanism being actuated to unlock the tabletop in response to the pivoting motion of the second leg panel.

14. The table apparatus of claim 9, wherein the base comprises caster wheels to engage the floor surface, wherein a majority of each caster wheel is concealed from view by feet of the base.

15. The table apparatus of claim 9, further comprising four tabletop leveling mechanisms mounted proximate to the lower surface of the tabletop, each of the four tabletop leveling mechanisms being configured to at least partially control a height adjustment of a respective corner of the tabletop.

16. The table apparatus of claim 9, further comprising a plurality of gang mechanisms mounted proximate to the lower surface of the tabletop such that each of the gang mechanisms resides in a respective cavity in the lower surface of the tabletop, wherein each gang mechanism is adjustable between a non-deployed position in which the entire gang mechanism is retained at or above of the lower surface of the tabletop when the upper surface of the tabletop is in the generally horizontal orientation and a deployed position in which at least a portion of the gang mechanism is configured to couple with another tabletop.

17. The table apparatus of claim 9, further comprising:

an adjustable catch mechanism to secure the first leg panel in a generally aligned orientation with a first vertical support member of the base when the first leg panel is pivoted toward the first vertical support member, the adjustable catch mechanism comprising a first catch component mounted to the first vertical support member such that a position of the first catch component is manually adjustable relative to the first vertical support member.

18. A method of adjusting a table apparatus, comprising:

rotating a first leg panel relative to a first base assembly about a first generally vertical axis while a tabletop extends in a generally horizontal orientation, the first leg panel having a first major surface extending generally vertically and being defined by a first panel width and a first panel height, the first panel width and the first panel height being substantially greater than a first panel thickness;

rotating a second leg panel relative to a second base assembly about a second generally vertical axis while the tabletop is in a generally horizontal orientation, the second leg panel having a second major surface extending generally vertically and being defined by a second panel width and a second panel height, the second panel width and the second panel height being substantially greater than a second panel thickness;

after rotating the first and second leg panels about the first and second generally vertical axes, rotating the tabletop about a generally horizontal axis from the generally horizontal orientation to a generally vertical orientation while the first and second base assemblies are each maintained in a generally vertical orientation to engage a floor surface.

19. The method of claim 18, wherein rotating the first and second leg panels about the first and second generally vertical axes adjusts the tabletop from a locked condition to an unlocked condition, wherein when the tabletop is in the unlocked condition, the tabletop is rotatable about the generally horizontal axis from the generally horizontal orientation to the generally vertical orientation.

20. The method of claim 18, further comprising adjusting a first brake mechanism away from the floor surface in response to adjustment of the tabletop from the generally horizontal orientation to the generally vertical orientation, the first brake mechanism being configured to secure the first base assembly in a generally stationary position relative to the floor surface when the tabletop is in the generally horizontal orientation.

21. A table apparatus, comprising:

a tabletop including an upper surface and a lower surface, the tabletop extending in a generally horizontal orientation when the table apparatus is in a deployed position, the tabletop being pivotable about a generally horizontal axis to adjust the tabletop from the generally horizontal orientation to a generally vertical orientation;

a first lock mechanism to retain the tabletop in the generally horizontal orientation, the first lock mechanism being actuated in a linear motion to unlock the tabletop in response to a pivoting motion of a first leg member; and a second lock mechanism to retain the tabletop in the generally horizontal orientation, the second lock mechanism being spaced apart from the first lock mechanism, the second lock mechanism being actuated in a linear motion to unlock the tabletop in response to a pivoting motion of a second leg member.

22. The table apparatus of claim 21, wherein the first leg member comprises a first pivotable leg panel and the second leg member comprises a second pivotable leg panel, the first and second pivotable leg panels extending generally vertically downward away from the lower surface of tabletop when the upper surface of the tabletop is in the generally horizontal orientation, the first pivotable leg panel being pivotable relative to a base about a first generally vertical axis while the upper surface of the tabletop is in the generally horizontal orientation, the second pivotable leg panel being pivotable relative to the base about a second generally vertical axis while the upper surface of the tabletop is in the generally horizontal orientation, wherein each of the first and second leg panels have a major surface extending generally vertically and being defined by a panel width and a panel height, the panel width being greater than or equal to half the width of the tabletop, the panel height being greater than the panel width.

23. The table apparatus of claim 21, further comprising four tabletop leveling mechanisms mounted proximate to the lower surface of the tabletop, each of the four tabletop leveling mechanisms being configured to at least partially control a height adjustment of a respective corner of the tabletop.

24. The table apparatus of claim 21, further comprising a plurality of gang mechanisms mounted proximate to the lower surface of the tabletop such that each of the gang mechanisms resides in a respective cavity in the lower surface of the tabletop, wherein each gang mechanism is adjustable between a non-deployed position in which the entire gang mechanism is retained at or above of the lower surface of the tabletop when the upper surface of the tabletop is in the generally horizontal orientation and a deployed position in which at least a portion of the gang mechanism is configured to couple with another tabletop.

25. A table apparatus, comprising:

a tabletop including an upper surface and a lower surface, the tabletop extending in a generally horizontal orientation when the table apparatus is in a deployed position, the tabletop being pivotable about a generally horizontal axis to adjust the tabletop from the generally horizontal orientation to a generally vertical orientation;

first and second base assemblies extending between a floor surface and the tabletop, each of the first and second base assemblies comprising wheels to engage the floor surface;

a first floor brake mechanism to secure the first base assembly in a generally stationary position relative to the floor surface when the tabletop is in the generally horizontal orientation, the first floor brake mechanism extending at least partially through the first base assembly and being spring biased away from the floor surface such that the first floor brake mechanism is configured to rise away from the floor surface in response to adjustment of the tabletop from the generally horizontal orientation to a generally vertical orientation; and a second floor brake mechanism to secure the second base assembly in a generally stationary position relative to the floor surface when the tabletop is in the generally horizontal orientation, the second floor brake mechanism being spaced apart from the first floor brake mechanism, the second floor brake mechanism extending at least partially through the second base assembly and being spring biased away from the floor surface such that the second floor brake mechanism is configured to rise away from the floor surface in response to adjustment of the tabletop from the generally horizontal orientation to a generally vertical orientation.

26. The table apparatus of claim 25, further comprising first and second pivotable leg panels extending generally vertically downward away from the lower surface of tabletop when the upper surface of the tabletop is in the generally horizontal orientation, the first pivotable leg panel being pivotable relative to the first base assembly about a first generally vertical axis while the upper surface of the tabletop is in the generally horizontal orientation, the second pivotable leg panel being pivotable relative to the second base assembly about a second generally vertical axis while the upper surface of the tabletop is in the generally horizontal orientation, wherein each of the first and second leg panels have a major surface extending generally vertically and being defined by a panel width and a panel height, the panel width being greater than or equal to half the width of the tabletop, the panel height being greater than the panel width.

27. The table apparatus of claim 25, further comprising four tabletop leveling mechanisms mounted proximate to the lower surface of the tabletop, each of the four tabletop leveling mechanisms being configured to at least partially control a height adjustment of a respective corner of the tabletop.

28. A table apparatus, comprising:

at least one base extending generally vertically from a floor surface;

a tabletop positioned over the at least one base and including an upper surface and a lower surface that extend toward four corners of the tabletop, the upper surface of the tabletop being configured to extend in a generally horizontal orientation; and four tabletop leveling mechanisms mounted proximate to the lower surface of the tabletop such that each of the four tabletop leveling mechanisms is mounted in a position vertically closer to the lower surface of tabletop than to the at least one base, each of the four tabletop leveling mechanisms including a rotatable adjustment member proximate to the lower surface of the tabletop, the rotatable adjustment member being fully rotatable to at least partially control a height adjustment of a respective corner of the four corners of the tabletop.

29. The table apparatus of claim 28, further comprising first and second pivotable leg panels extending generally vertically downward away from the lower surface of tabletop when the upper surface of the tabletop is in the generally horizontal orientation, the first pivotable leg panel being pivotable about a first generally vertical axis while the upper surface of the tabletop is in the generally horizontal orientation, the second pivotable leg panel being pivotable about a second generally vertical axis while the upper surface of the tabletop is in the generally horizontal orientation, wherein each of the first and second leg panels have a major surface extending generally vertically and being defined by a panel width and a panel height, the panel width being greater than or equal to half the width of the tabletop, the panel height being greater than the panel width.

30. The table apparatus of claim 28, further comprising a base movably coupled with the tabletop, and a first brake mechanism to secure the base in a generally stationary position relative to the floor surface when the tabletop is in the generally horizontal orientation, the first brake mechanism extending at least partially through the base and being spring biased away from the floor surface such that the first brake mechanism is configured to rise away from the floor surface in response to adjustment of the tabletop from the generally horizontal orientation to the generally vertical orientation.

31. A table apparatus, comprising:

a tabletop positioned over the at least one base and including an upper surface and a lower surface that extend toward four corners of the tabletop, the upper surface of the tabletop being configured to extend in a generally horizontal orientation; and four gang mechanisms mounted proximate to the lower surface of the tabletop such that each of the four gang mechanisms resides in a respective cavity in the lower surface of the tabletop, wherein each gang mechanism is adjustable between a non-deployed position in which the entire gang mechanism is retained at or above of the lower surface of the tabletop when the upper surface of the tabletop is in the generally horizontal orientation and a deployed orientation in which at least a portion of the gang mechanism is configured to couple with another tabletop.

32. The table apparatus of claim 31, further comprising first and second pivotable leg panels extending generally vertically downward away from the lower surface of tabletop when the upper surface of the tabletop is in the generally horizontal orientation, the first pivotable leg panel being pivotable about a first generally vertical axis while the upper surface of the tabletop is in the generally horizontal orientation, the second pivotable leg panel being pivotable about a second generally vertical axis while the upper surface of the tabletop is in the generally horizontal orientation, wherein each of the first and second leg panels have a major surface extending generally vertically and being defined by a panel width and a panel height, the panel width being greater than or equal to half the width of the tabletop, the panel height being greater than the panel width.

33. The table apparatus of claim 31, further comprising four tabletop leveling mechanisms mounted proximate to the lower surface of the tabletop, each of the four tabletop leveling mechanisms being configured to at least partially control a height adjustment of a respective corner of the tabletop.

34. A table apparatus, comprising:

a tabletop positioned over the at least one base and including an upper surface and a lower surface that extend toward four corners of the tabletop, the upper surface of the tabletop being configured to extend in a generally horizontal orientation; and four gang mechanisms mounted proximate to the lower surface of the tabletop such that each of the four gang mechanisms is mounted proximate to a respective one of the four corners of the tabletop and is configured to couple with another tabletop, wherein each gang mechanism is spaced apart from a perimeter of the tabletop when in a non-deployed position and extends for a longitudinal length that is a maximum dimension for the gang mechanism, wherein the longitudinal length of the gang mechanism located proximate to a first corner of the tabletop extends generally perpendicularly to the longitudinal lengths of the two gang mechanisms located proximate to the two corners of the tabletop that are neighboring the first corner of the tabletop.

35. The table apparatus of claim 34, further comprising first and second pivotable leg panels extending generally vertically downward away from the lower surface of tabletop when the upper surface of the tabletop is in the generally horizontal orientation, the first pivotable leg panel being pivotable about a first generally vertical axis while the upper surface of the tabletop is in the generally horizontal orientation, the second pivotable leg panel being pivotable about a second generally vertical axis while the upper surface of the tabletop is in the generally horizontal orientation, wherein each of the first and second leg panels have a major surface extending generally vertically and being defined by a panel width and a panel height, the panel width being greater than or equal to half the width of the tabletop, the panel height being greater than the panel width.

36. The table apparatus of claim 34, further comprising a base movably coupled with the tabletop, and a first brake mechanism to secure the base in a generally stationary position relative to the floor surface when the tabletop is in the generally horizontal orientation, the first brake mechanism extending at least partially through the base and being spring biased away from the floor surface such that the first brake mechanism is configured to rise away from the floor surface in response to adjustment of the tabletop from the generally horizontal orientation to the generally vertical orientation.

37. A table apparatus, comprising:

a tabletop positioned over at least one base and including an upper surface, a lower surface, and at least one table edge, the upper surface of the tabletop being configured to extend in a generally horizontal orientation; and a gang mechanism mounted proximate to the lower surface of the tabletop and proximate to the table edge, wherein the gang mechanism includes a movable member having a single degree of freedom, the movable member of the gang mechanism being adjustable between a non-deployed position in which the movable member is spaced apart from a perimeter of the tabletop and a deployed position in which the movable member of the gang mechanism is configured to couple with another tabletop.

38. The table apparatus of claim 37, further comprising first and second pivotable leg panels extending generally vertically downward away from the lower surface of tabletop when the upper surface of the tabletop is in the generally horizontal orientation, the first pivotable leg panel being pivotable about a first generally vertical axis while the upper surface of the tabletop is in the generally horizontal orientation, the second pivotable leg panel being pivotable relative about a second generally vertical axis while the upper surface of the tabletop is in the generally horizontal orientation, wherein each of the first and second leg panels have a major surface extending generally vertically and being defined by a panel width and a panel height, the panel width being greater than or equal to half the width of the tabletop, the panel height being greater than the panel width.

39. The table apparatus of claim 37, further comprising four tabletop leveling mechanisms mounted proximate to the lower surface of the tabletop, each of the four tabletop leveling mechanisms being configured to at least partially control a height adjustment of a respective corner of the tabletop.

40. A table apparatus, comprising:

a tabletop positioned over at least one base and including an upper surface, a lower surface, and at least one table edge, the upper surface of the tabletop being configured to extend in a generally horizontal orientation; and a gang mechanism mounted proximate to the lower surface of the tabletop and proximate to the table edge, wherein the gang mechanism includes a fixed member and a movable member that is movable between a non-deployed position in which the movable member is spaced apart from a perimeter of the tabletop and a deployed position in which the movable member of the gang mechanism is configured to couple with another tabletop, wherein the movable member of the gang mechanism is retained in the non-deployed position by a magnetic force between first magnetically attractive component of the movable member and a second magnetically attractive component of the fixed member.

41. The table apparatus of claim 40, further comprising first and second pivotable leg panels extending generally vertically downward away from the lower surface of tabletop when the upper surface of the tabletop is in the generally horizontal orientation, the first pivotable leg panel being pivotable about a first generally vertical axis while the upper surface of the tabletop is in the generally horizontal orientation, the second pivotable leg panel being pivotable about a second generally vertical axis while the upper surface of the tabletop is in the generally horizontal orientation, wherein each of the first and second leg panels have a major surface extending generally vertically and being defined by a panel width and a panel height, the panel width being greater than or equal to half the width of the tabletop, the panel height being greater than the panel width.

42. The table apparatus of claim 40, further comprising a base movably coupled with the tabletop, and a first brake mechanism to secure the base in a generally stationary position relative to the floor surface when the tabletop is in the generally horizontal orientation, the first brake mechanism extending at least partially through the base and being spring biased away from the floor surface such that the first brake mechanism is configured to rise away from the floor surface in response to adjustment of the tabletop from the generally horizontal orientation to the generally vertical orientation.

43. A table apparatus, comprising:

a tabletop including an upper surface and a lower surface, the upper surface of the tabletop extending in a generally horizontal orientation when the table apparatus is in a deployed position, and the tabletop being adjustable about a generally horizontal axis to adjust the upper surface of the tabletop from the generally horizontal orientation to a generally vertical orientation; and first and second pivotable leg panels extending generally vertically downward away from the lower surface of tabletop when the upper surface of the table top is in the generally horizontal orientation, wherein each of the first and second pivotable leg panels are biased to automatically adjust from a lower vertical height to a higher vertical height in response to the tabletop being pivoted about the generally horizontal axis to adjust the upper surface of the tabletop from the generally horizontal orientation to the generally vertical orientation.

44. The table apparatus of claim 43, wherein the first and second pivotable leg panels adjust from the lower vertical height to the higher vertical height to provide clearance for a base of nested table when nesting a plurality of tables.

45. The table apparatus of claim 43, wherein when the first and second pivotable leg panels are pivoted to a first position, the tabletop is locked in the generally horizontal orientation, and when the first and second pivotable leg panels are pivoted to a second position, the tabletop is unlocked for adjustment to the generally vertical orientation, wherein each of the first and second pivotable leg panels have a major surface extending generally vertically and being defined by a panel width and a panel height, the panel width being greater than or equal to half the width of the tabletop, the panel height being greater than the panel width.

46. The table apparatus of claim 43, further comprising a base movably coupled with the tabletop, and a first brake mechanism to secure the base in a generally stationary position relative to the floor surface when the tabletop is in the generally horizontal orientation, the first brake mechanism extending at least partially through the base and being spring biased away from the floor surface such that the first brake mechanism is configured to rise away from the floor surface in response to adjustment of the tabletop from the generally horizontal orientation to the generally vertical orientation.

47. A table apparatus, comprising:

at least a first base to extend generally vertically from a floor surface;

a tabletop positioned above the first base and including an upper surface and a lower surface, the upper surface of the tabletop extending in a generally horizontal orientation when the table apparatus is in a deployed position;

a least a first pivotable leg panel extending generally vertically downward away from the lower surface of tabletop when the upper surface of the tabletop is in the generally horizontal orientation, the first pivotable leg panel being pivotable relative to the first base and the tabletop about a first generally vertical axis while the upper surface of the tabletop is in the generally horizontal orientation; and an adjustable catch mechanism to secure the first pivotable leg panel in a generally aligned orientation with the first base when the first pivotable leg panel is pivoted toward the first base, the adjustable catch mechanism comprising a first catch component mounted to the first base such that the first catch component is manually adjustable relative to the first base.

48. The table apparatus of claim 47, wherein the adjustable catch mechanism comprises a second catch component mounted to the first pivotable leg panel such that the second catch component mates with the first catch component when the first pivotable leg panel is in the generally aligned orientation with the first base.

49. The table apparatus of claim 47, further comprising:

four tabletop leveling mechanisms mounted proximate to the lower surface of the tabletop, each of the four tabletop leveling mechanisms being configured to at least partially control a height adjustment of a respective corner of the tabletop; and a plurality of gang mechanisms mounted proximate to the lower surface of the tabletop such that each of the gang mechanisms resides in a respective cavity in the lower surface of the tabletop, wherein each gang mechanism is adjustable between a non-deployed position in which the entire gang mechanism is retained at or above of the lower surface of the tabletop when the upper surface of the tabletop is in the generally horizontal orientation and a deployed position in which at least a portion of the gang mechanism is configured to couple with another tabletop.

50. The table apparatus of claim 47, further comprising a second pivotable leg panel extending generally vertically downward away from the lower surface of tabletop when the upper surface of the tabletop is in the generally horizontal orientation, the second pivotable leg panel being pivotable about a second generally vertical axis while the upper surface of the tabletop is in the generally horizontal orientation, wherein pivoting the first and second pivotable leg panels about the first and second generally vertical axes adjusts the tabletop from a locked condition to an unlocked condition, wherein each of the first and second pivotable leg panels have a major surface extending generally vertically and being defined by a panel width and a panel height, the panel width being greater than or equal to half the width of the tabletop, the panel height being greater than the panel width.

* * * * *